US010522089B2

(12) United States Patent
Kim et al.

(10) Patent No.: US 10,522,089 B2
(45) Date of Patent: Dec. 31, 2019

(54) DISPLAY DEVICE

(71) Applicant: Samsung Display Co., Ltd., Yongin-Si, Gyeonggi-Do (KR)

(72) Inventors: Yang Wan Kim, Yongin-si (KR); Sun Ja Kwon, Yongin-si (KR); Byung Sun Kim, Yongin-si (KR); Hyun Ae Park, Yongin-si (KR); Su Jin Lee, Yongin-si (KR); Jae Yong Lee, Yongin-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 16/524,273

(22) Filed: Jul. 29, 2019

(65) Prior Publication Data

US 2019/0355310 A1 Nov. 21, 2019

Related U.S. Application Data

(63) Continuation of application No. 15/420,382, filed on Jan. 31, 2017, now Pat. No. 10,388,227.

(30) Foreign Application Priority Data

May 19, 2016 (KR) ..... 10-2016-0061626

(51) Int. Cl.
*G09G 3/3233* (2016.01)
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 3/3233* (2013.01); *G09G 2300/0426* (2013.01); *G09G 2310/0213* (2013.01); *G09G 2310/0286* (2013.01); *G09G 2310/08* (2013.01); *G09G 2320/0223* (2013.01); *G09G 2320/0233* (2013.01)

(58) Field of Classification Search
None
See application file for complete search history.

(56) References Cited

U.S. PATENT DOCUMENTS

| | | | |
|---|---|---|---|
| 2005/0180083 | A1 | 8/2005 | Takahara et al. |
| 2006/0114216 | A1 | 6/2006 | Shim |
| 2008/0111649 | A1 | 5/2008 | Ryu |
| 2010/0156945 | A1 | 6/2010 | Yoshida |

(Continued)

FOREIGN PATENT DOCUMENTS

| | | | |
|---|---|---|---|
| KR | 10-2004-0050523 | A | 6/2004 |
| KR | 10-2008-0060886 | A | 7/2008 |
| KR | 10-1376654 | B1 | 3/2014 |

*Primary Examiner* — Parul H Gupta
(74) *Attorney, Agent, or Firm* — Innovation Counsel LLP

(57) ABSTRACT

A display device has a substrate with a first pixel area and a second pixel area smaller than the first pixel area. First pixels in the first pixel area are connected with first scan lines. Second pixels in the second pixel area are connected with second scan lines. A first scan driver supplies a first scan signal to the first scan lines, and a second scan driver supplies a second scan signal to the second scan lines. A first signal line supplies a first driving signal to the first and second scan drivers. The first signal line includes first sub signal line to supply the first driving signal to the first scan driver, a second sub signal line to supply the first driving signal to the second scan driver, and a first load matching resistor connected between the first sub signal line and the second sub signal line.

20 Claims, 22 Drawing Sheets

(56) References Cited

U.S. PATENT DOCUMENTS

| | | | | |
|---|---|---|---|---|
| 2016/0005346 | A1 | 1/2016 | Kim | |
| 2016/0180790 | A1 | 6/2016 | Park et al. | |
| 2016/0307543 | A1 | 10/2016 | Lim | |
| 2018/0129106 | A1* | 5/2018 | Gao | G02F 1/134363 |

* cited by examiner

DISPLAY DEVICE

CROSS-REFERENCE TO RELATED APPLICATION

This application is a continuation application of U.S. patent application Ser. No. 15/420,382 filed on Jan. 31, 2017, which claims priority under 35 USC § 119 to Korean Patent Application No. 10-2016-0061626, filed on May 19, 2016, in the Korean Intellectual Property Office, the disclosures of which are incorporated herein in their entirety by reference.

BACKGROUND

1. Field

One or more embodiments described herein relate to a display device.

2. Description of the Related Art

An organic light emitting display device includes a plurality of pixels, each of which includes an organic light emitting diode. Each diode has an organic light emitting layer between two electrodes. Electrons injected from one electrode and holes injected from the other electrode combine in the organic light emitting layer to form excitons. Light is emitted from the diode when the excitons change to a stable state.

The organic light emitting diodes are controlled by transistors connected to driving lines. The driving lines may have different loads depending on their positions. The different loads may cause brightness deviation of the pixels.

SUMMARY

In accordance with one or more embodiments, a display device includes a substrate having a first pixel area and a second pixel area, the second pixel area smaller than the first pixel area; first pixels in the first pixel area and connected with first scan lines; second pixels in the second pixel area and connected with second scan lines; a first scan driver to supply a first scan signal to the first scan lines; a second scan driver to supply a second scan signal to the second scan lines; and a first signal line to supply a first driving signal to the first scan driver and the second scan driver, wherein the first signal line includes: a first sub signal line to supply the first driving signal to the first scan driver; a second sub signal line to supply the first driving signal to the second scan driver; and a first load matching resistor connected between the first sub signal line and the second sub signal line.

The first sub signal line may receive the first driving signal and transmit the first driving signal to the second sub signal line through the first load matching resistor. The number of second pixels may be less than the number of first pixels. The second scan lines may be shorter than the first scan lines. The first driving signal may be a clock signal. The substrate may have a third pixel area smaller than the first pixel area.

The display device may include third pixels in the third pixel area and connected with third scan lines; a third scan driver to supply a third scan signal to the third scan lines; and a second signal line to supply a second driving signal to the third scan driver. The second pixel area and the third pixel area may be at one side of the first pixel area and spaced apart each other.

The display device may include a fourth scan driver to supply the first scan signal to the first scan lines. The first scan driver may be connected to first ends of the first scan lines, and the fourth scan driver may be connected to second ends of the first scan lines. The first scan driver and the fourth scan driver may supply a first scan signal to a same first scan line at a same time.

The second signal line may include a third sub signal line to supply the second driving signal to the fourth scan driver; a fourth sub signal line to supply the second driving signal to the second scan driver; and a second load matching resistor connected between the third sub signal line and the fourth sub signal line. The third sub signal line may receive the second driving signal and to transmit the second driving signal to the fourth sub signal line through the second load matching resistor. A number of third pixels may be less than a number of first pixels. The third scan lines may be shorter than the first scan lines. The second driving signal may be a clock signal.

The display device may include a first emission driver to supply a first emission control signal to the first pixels through first emission control lines; a second emission driver to supply a second emission control signal to the second pixels through second emission control lines; and a third signal line to supply a third driving signal to the first emission driver and the second emission driver.

The third signal line may include a fifth sub signal line to supply the third driving signal to the first emission driver; a sixth sub signal line to supply the third driving signal to the second emission driver; and a third load matching resistor connected between the fifth sub signal line and the sixth sub signal line.

The fifth sub signal line may receive the third driving signal and transmit the third driving signal to the sixth sub signal line through the third load matching resistor. The second emission control lines may be shorter than the first emission control lines. The third driving signal may include a clock signal.

In accordance with one or more other embodiments, a display device includes a substrate having a first pixel area and a second pixel area, the second pixel area smaller than the first pixel area; first pixels in the first pixel area and connected with first scan lines; second pixels in the second pixel area and connected with second scan lines; a first scan driver to supply a first scan signal to the first scan lines; a second scan driver to supply a second scan signal to the second scan lines; and first load matching resistors connected between the second scan driver and the second scan lines.

A number of second pixels may be smaller than a number of first pixels. The second scan lines may be shorter than the first scan lines. The substrate may include a third pixel area smaller than the first pixel area. The display device may include third pixels in the third pixel area and connected with third scan lines; and a third scan driver to supply a third scan signal to the third scan lines. The second pixel area and the third pixel area may be at one side of the first pixel area and spaced apart each other The display device may include a fourth scan driver to supply the first scan signal to the first scan lines. The first scan driver may be connected to first ends of the first scan lines, and the fourth scan driver may be connected to second ends of the first scan lines. The first scan driver and the fourth scan driver may supply a first scan signal to a same first scan line at a same time. The display device may include second load matching resistors connected between the third scan driver and the third scan lines. A number of third pixels may be less than a number of first pixels. The third scan lines may be shorter than the first scan lines.

The display device may include a first emission driver to supply a first emission control signal to the first pixels through first emission control lines; and a second emission driver to supply a second emission control signal to the second pixels through second emission control lines. The display device may include third load matching resistors between the second emission driver and the second emission control lines. The second emission control lines may be shorter than the first emission control lines.

BRIEF DESCRIPTION OF THE DRAWINGS

Features will become apparent to those of skill in the art by describing in detail exemplary embodiments with reference to the attached drawings in which.

DETAILED DESCRIPTION

Figure 1A:
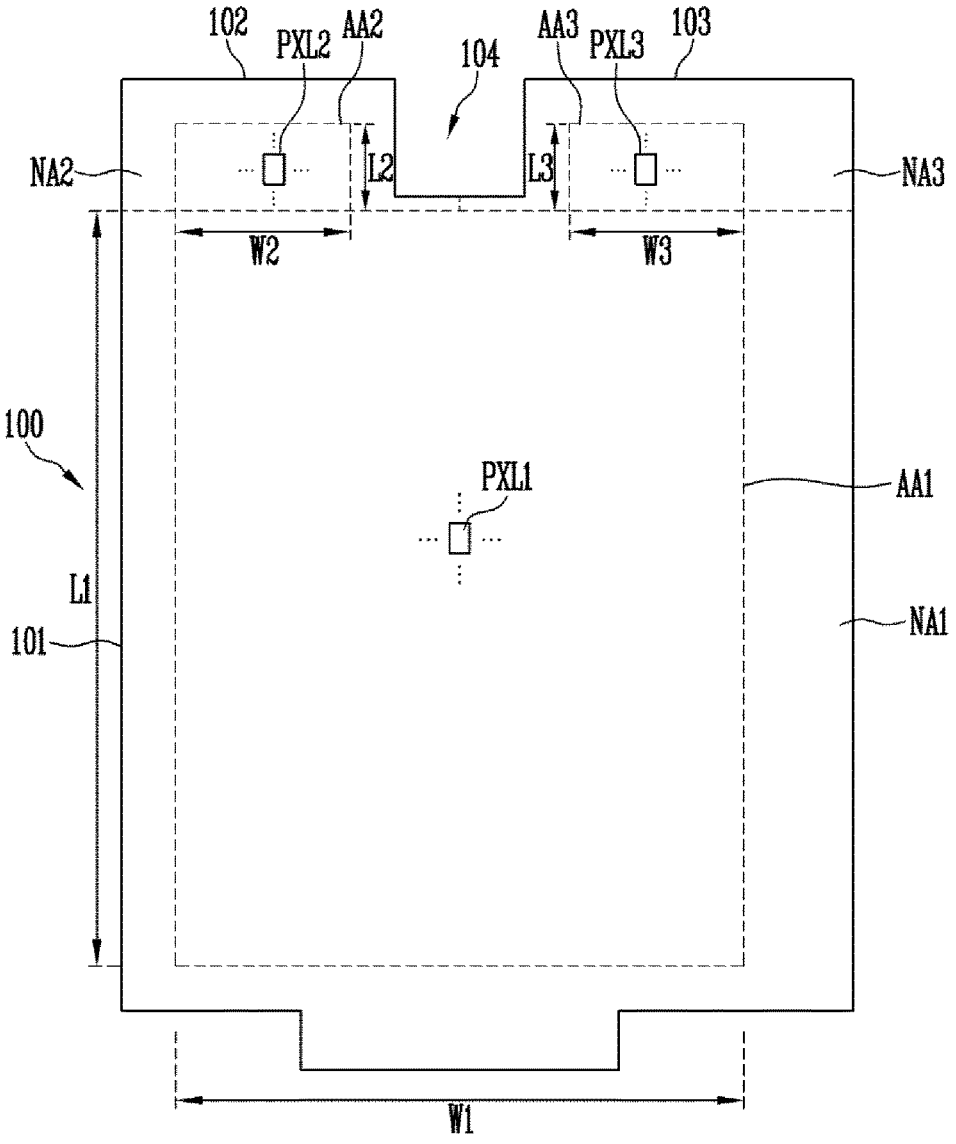
FIGS. 1A-1E illustrate various embodiments of a pixel region.

Example embodiments will now be described with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIGS. 1A-1E illustrate various embodiments of a pixel region.

Referring to FIG. 1A, a substrate 100 may include pixel areas and neighboring areas NA1, NA2, and NA3. A plurality of pixels PXL1, PXL2, and PXL3 are in the pixel areas. Thus, the pixel areas may display a predetermined image. (The pixel areas may be display areas).

Constituent elements (for example, a driver and a line) for driving the pixels PXL1, PXL2, PXL3 may be in the neighboring areas NA1, NA2, and NA3. The pixels PXL1, PXL2, and PXL3 may not be present in the neighboring areas NA1, NA2, and NA3. (The neighboring areas NA1, NA2, and NA3 may be referred to as non-display areas). For example, the neighboring areas NA1, NA2, and NA3 may be present at outer sides of the pixel areas and may surround at least parts of the pixel areas.

The pixel areas may include a first pixel area AA1, and a second pixel area AA2 and a third pixel area AA3 at one side of the first pixel area AA1. The second pixel area AA2 and the third pixel area AA3 may be spaced apart from each other. The first pixel area AA1 may have a larger area than the second pixel area AA2 and the third pixel area AA3. For example, a width W1 of the first pixel area AA1 may be larger than widths W2 and W3 of other pixel areas AA2 and AA3. A length L1 of the first pixel area AA1 may be larger than lengths L2 and L3 of other pixel areas AA2 and AA3.

The second pixel area AA2 and the third pixel area AA3 may have smaller areas than the first pixel area AA1 and may have the same area or different areas. For example, the width W2 of the second pixel area AA2 may be the same as or different from the width W3 of the third pixel area AA3. The length L2 of the second pixel area AA2 may be the same as or different from the width L3 of the third pixel area AA3.

The neighboring areas NA1, NA2, and NA3 may include the first neighboring area NA1, the second neighboring area NA2, and the neighboring area NA3. The first neighboring area NA1 is around the first pixel area AA1 and may surround at least a part of the first pixel area AA1. A width of the first neighboring area NA1 may be generally the same. In another embodiment, the width of the first neighboring area NA1 may be different depending, for example, on position.

The second neighboring area NA2 is around the second pixel area AA2 and may surround at least a part of the second pixel area AA2. A width of the second neighboring area NA2 may be generally the same. In another embodiment, the width of the second neighboring area NA2 may be different depending, for example, on position.

The third neighboring area NA3 is around the third pixel area AA3 and may surround at least a part of the third pixel area AA3. A width of the third neighboring area NA3 may be generally the same. In another embodiment, the width of the third neighboring area NA3 may be different depending, for example, on position.

The second neighboring area NA2 and the third neighboring area NA3 may or may not be connected to each other depending, for example, on a form of substrate 100.

Widths of the neighboring areas NA1, NA2, and NA3 may be generally the same. In another embodiment, the widths of the neighboring areas NA1, NA2, and NA3 may be different depending, for example, on position.

The pixels PXL1, PXL2, and PXL3 may include first pixels PXL1, second pixels PXL2, and third pixels PXL3. For example, the first pixels PXL1 may be in the first pixel area AA1, the second pixels PXL2 may be in the second pixel area AA2, and the third pixels PXL3 may be in the third pixel area AA3. The pixels PXL1, PXL2, and PXL3 may emit light with predetermined brightness according to control of the drivers in the neighboring areas NA1, NA2, and NA3. The pixels PXL1, PXL2, and PXL3 may include light emitting devices (for example, organic light emitting diodes).

The substrate 100 may have various forms which include the pixel areas AA1, AA2, and AA3 and the neighboring areas NA1, NA2, and NA3. For example, the substrate 100 may include a base substrate 101 have a plate shape. A first auxiliary plate 102 and a second auxiliary plate 103 may protrude from one end of the base substrate 101 in one direction. The first auxiliary plate 102 and the second auxiliary plate 103 may be integrally formed with the base substrate 101. A concave portion 104 may be present between the first auxiliary plate 102 and the second auxiliary plate 103. The concave portion 104 may be a region which is obtained by removing part of the substrate 100. Thus, the first auxiliary plate 102 may be spaced from the second auxiliary plate 103.

The first auxiliary plate 102 and the second auxiliary plate 103 may have smaller areas than the base substrate 101 and may have the same area or different areas. The first auxiliary plate 102 and the second auxiliary plate 103 may have various shapes including the pixel areas AA1 and AA2 and the neighboring areas NA1 and NA2. In this case, the first pixel area AA1 and the first neighboring area NA1 may be in the base substrate 101. The second pixel area AA2 and the second neighboring area NA2 may be in the first auxiliary plate 102. The third pixel area AA3 and the third neighboring area NA3 may be in the second auxiliary plate 103.

Referring to FIG. 1A, the second neighboring area NA2 and the third neighboring area NA3 may be connected with each other between the concave portion 104 and the first pixel area AA1.

Figure 1B:
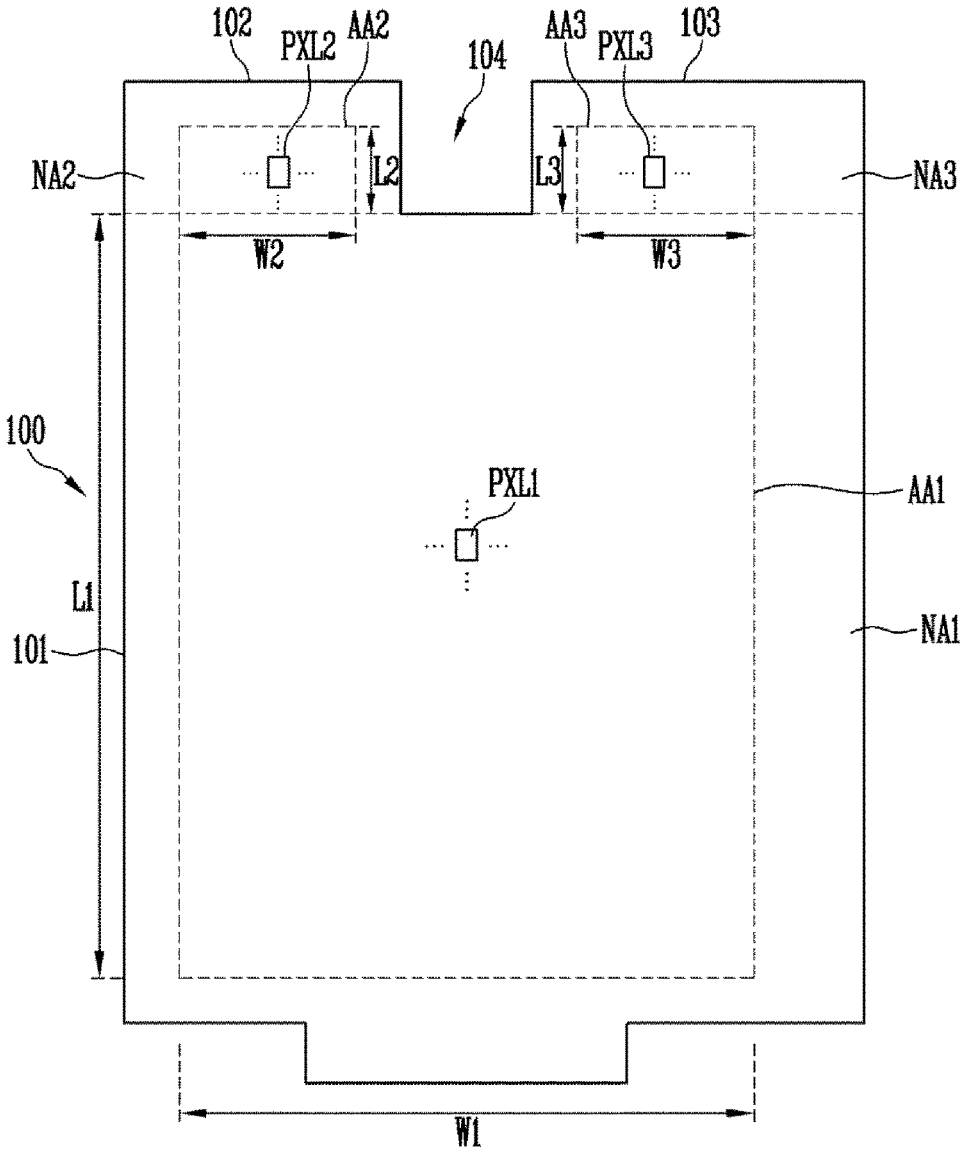

Referring to FIG. 1B, the second neighboring area NA2 and the third neighboring area NA3 may not be connected with each other depending, for example, on the forms of the concave portion 104 and the first pixel area AA1.

In another exemplary embodiment, a different number of auxiliary plates 102 and 103 may be included. For example, three or more auxiliary plates may be formed, or one of the first auxiliary plate 102 or the second auxiliary plate 103 may be omitted. When the second auxiliary plate 103 is omitted, the third pixel area AA3 may also be omitted. The position of the first auxiliary plate 102 may be variously changed. Further, the third pixel area AA3 may be omitted, and the drivers and the lines for driving the third pixels PXL3 may also be omitted.

The substrate 100 may be formed of an insulating material, such as glass and resin. Further, the substrate 100 may be formed of a material having flexibility so as to be bendable or foldable and may have a single-layer structure of a multi-layer structure. For example, the substrate 100 may include at least one of polystyrene, polyvinyl alcohol, polymethyl methacrylate, polyethersulfone, polyacrylate, polyetherimide, polyethylene naphthalate, polyethylene terephthalate, polyphenylene sulfide, polyarylate, polyimide, polycarbonate, triacetate cellulose, and cellulose acetate propionate. In another embodiment, the material of the substrate 100 may be different, e.g. formed of Fiber Glass Reinforced Plastic (FRP).

Figure 1C:
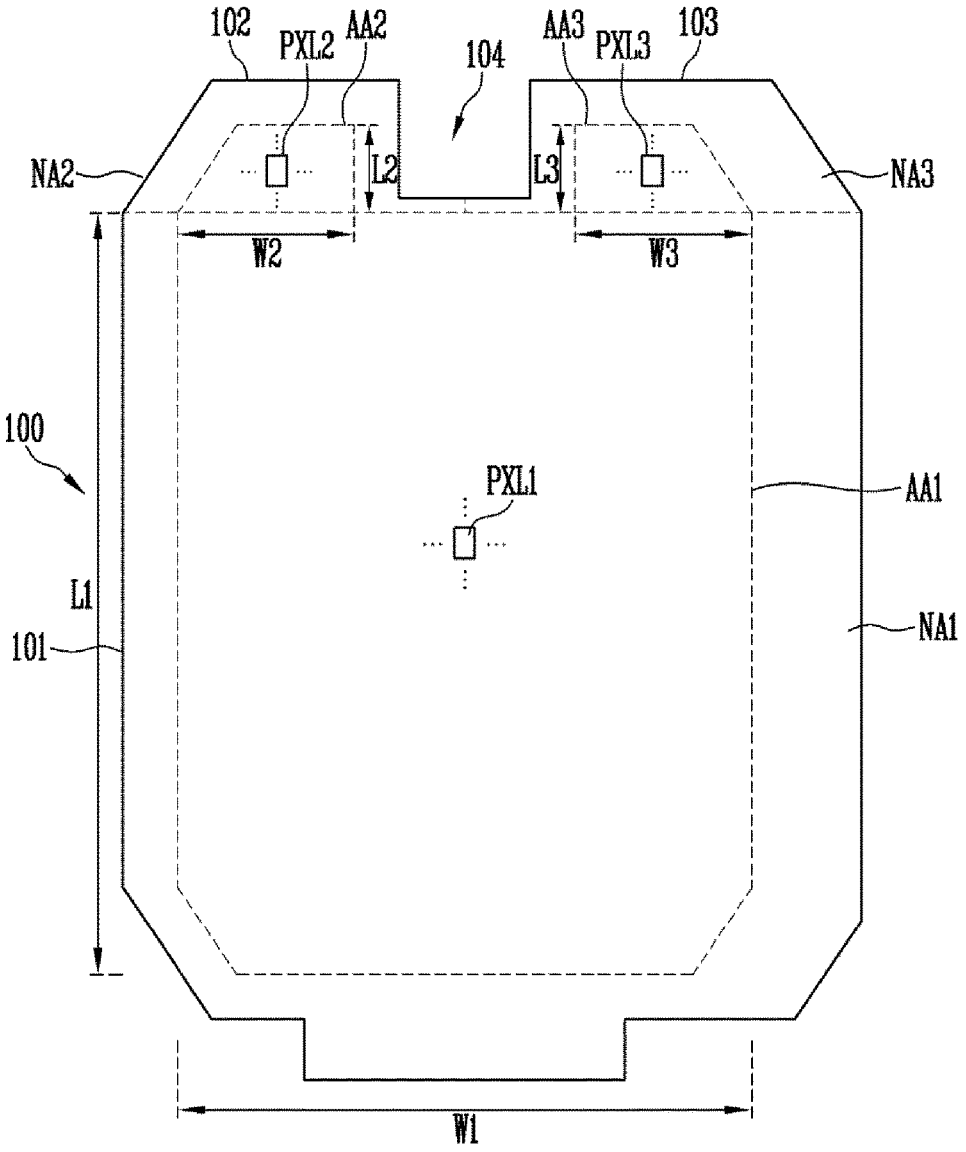

The first pixel area AA1 may have various shapes, e.g., polygon or circle. Further, at least a part of the first pixel area AA1 may have a curved form. For example, the first pixel area AA1 may have a quadrangular shape as in FIGS. 1A and 1B. Referring to FIG. 1C, a corner portion of the first pixel area AA1 may be slanted. In one embodiment, the corner portion of the first pixel area AA1 may be curved. In this case, a length L1 and/or a width W1 of the first pixel area AA1 may be changed based on position. The number of first pixels PXL1 positioned in one line (row and column) may be different based on the shape of the first pixel area AA1.

The base substrate 101 may also have various shapes, e.g., polygon or circle. Further, at least a part of the base substrate 101 may be curved. For example, the base substrate 101 may have a quadrangular shape as in FIGS. 1A and 1B. Referring to FIG. 1C, a corner portion of the base substrate 101 may be slanted or curved. The base substrate 101 may have a form which is the same as or similar to the first pixel area AA1, or a form which is different from the first pixel area AA1.

Figure 1D:
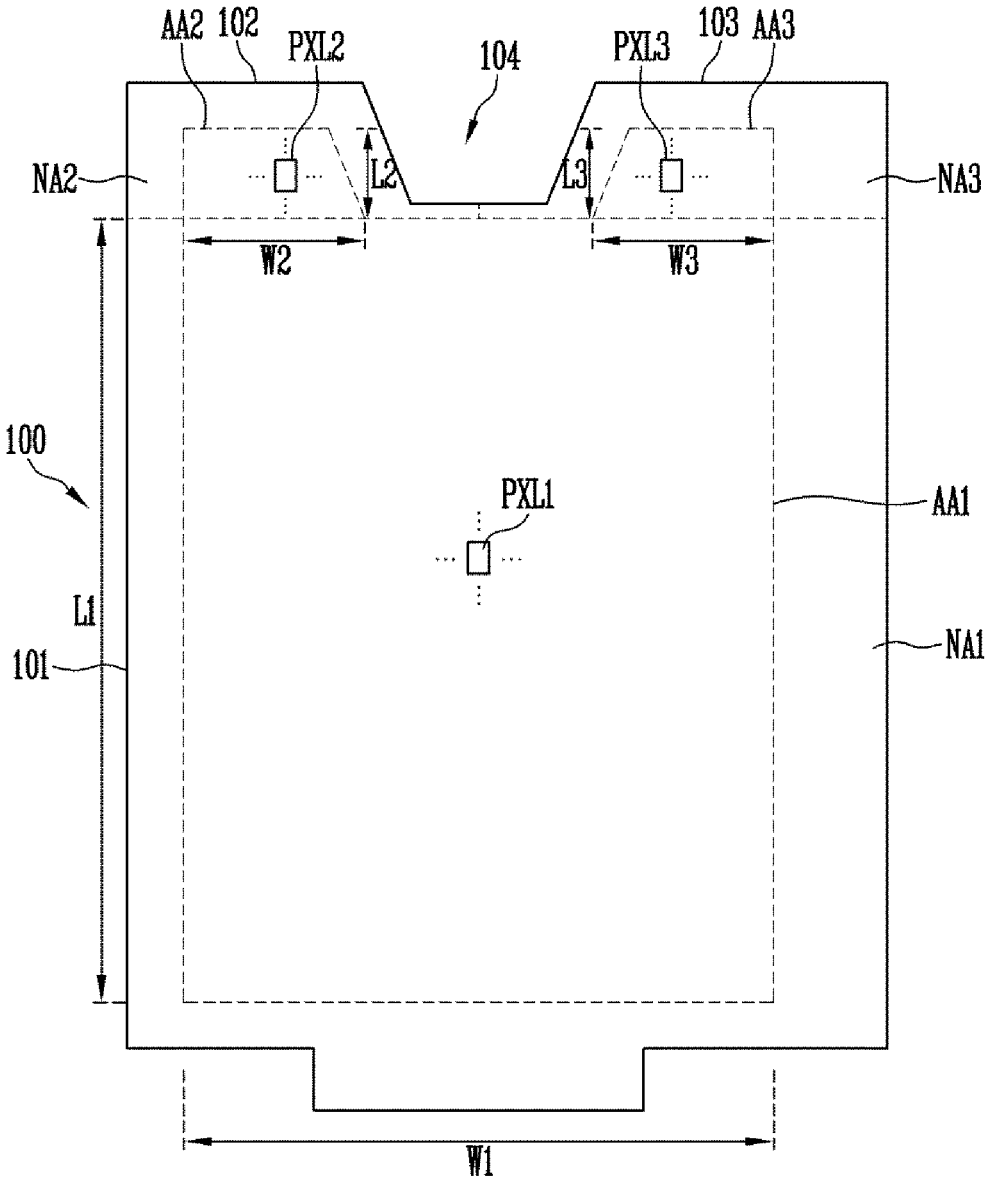

Each of the second pixel area AA2 and the third pixel area AA3 may have various shapes, e.g., polygon or circle. Further, at least a part of each of the second pixel area AA2 and the third pixel area AA3 may be curved. For example, the second pixel area AA2 and the third pixel area AA3 may have a quadrangular shape as in FIGS. 1A and 1B. Referring to FIGS. 1C and 1D, an external corner portion and an internal corner portion of each of the second pixel area AA2 and the third pixel area AA3 may be slanted or curved form.

Figure 1E:
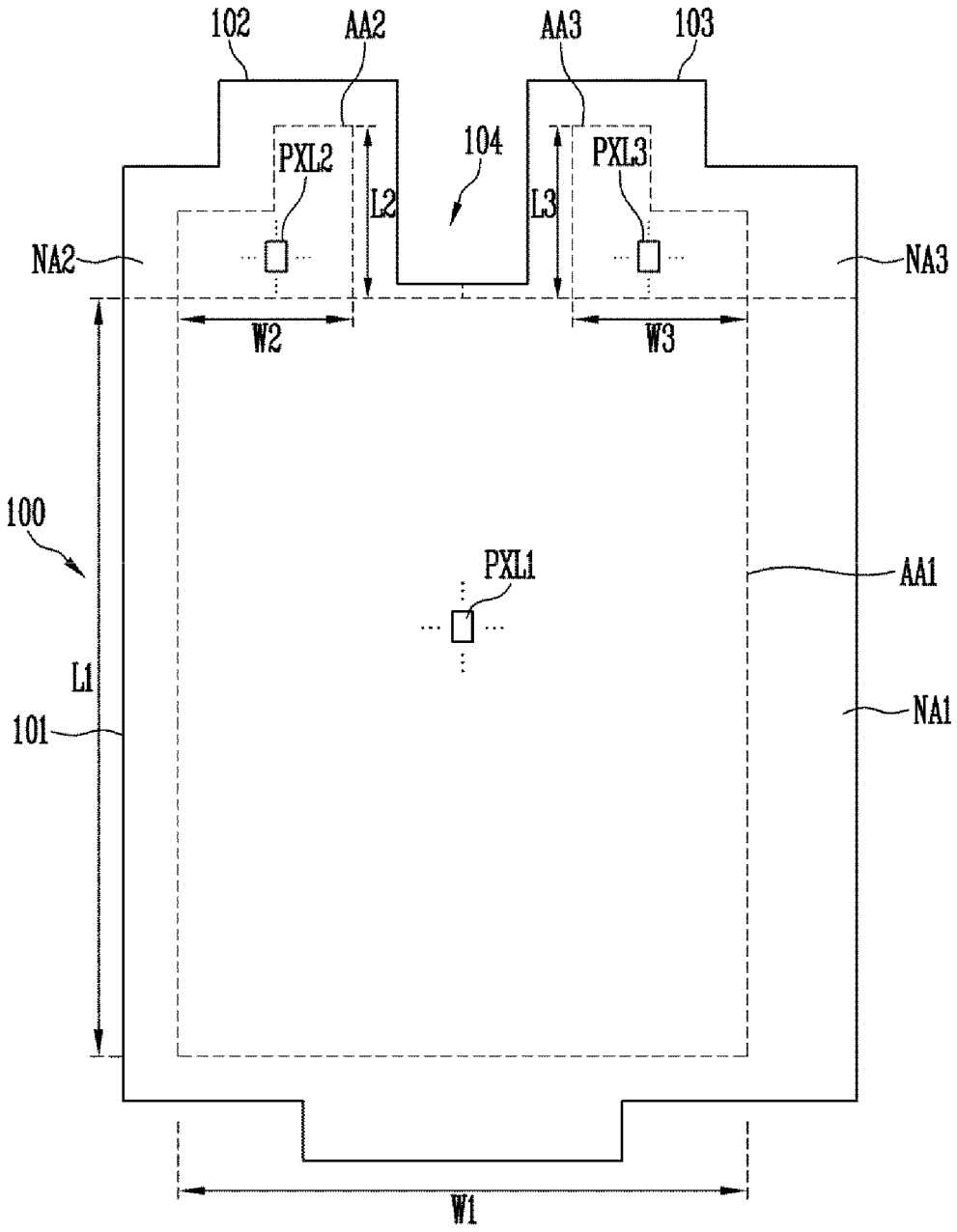

Referring to FIG. 1E, the corner portion of each of the second pixel area AA2 and the third pixel area AA3 may be stepped. In this case, the length L2 and/or the width W2 of the second pixel area AA2 may be different based on position. Further, the length L3 and/or the width W3 of the third pixel area AA3 may be different based on position.

The number of the second pixels PXL2 and the number of third pixels PXL3 in one line (row and column) may be different based on position and shape of the second pixel area AA2 and the third pixel area AA3. For example, in cases of FIGS. 1A and 1B, the number of the second pixels PXL2 and the number of third pixels PXL3 positioned in one line (row and column) may be uniformly set. However, in cases of FIGS. 1C to 1E, the number of the second pixels PXL2 and the number of third pixels PXL3 positioned in one line (row and column) may be different based on their positions.

The first auxiliary plate 102 and the second auxiliary plate 103 may have various shapes, e.g., polygon or circle. At least a part of each of the first auxiliary plate 102 and the second auxiliary plate 103 may also have a curved shape. For example, the first auxiliary plate 102 and the second auxiliary plate 103 may have a quadrangular shape as in FIGS. 1A and 1B. Referring to FIGS. 1C and 1D, an external corner portion and an internal corner portion of each of the first auxiliary plate 102 and the second auxiliary plate 103 may be slanted. In this case, the corner portion of each of the first auxiliary plate 102 and the second auxiliary plate 103 may be curved.

Referring to FIG. 1E, the corner portion of each of the first auxiliary plate 102 and the second auxiliary plate 103 may be stepped.

Each of the first auxiliary plate 102 and the second auxiliary plate 103 may have a form which is the same as or similar to the second pixel area AA2 and the third pixel area AA3 or a form different form the second pixel area AA2 and third pixel area AA3.

The concave portion 104 may have various shapes, e.g., polygon or circle. Qt least a part of the base substrate 104 may be curved.

Figure 2:
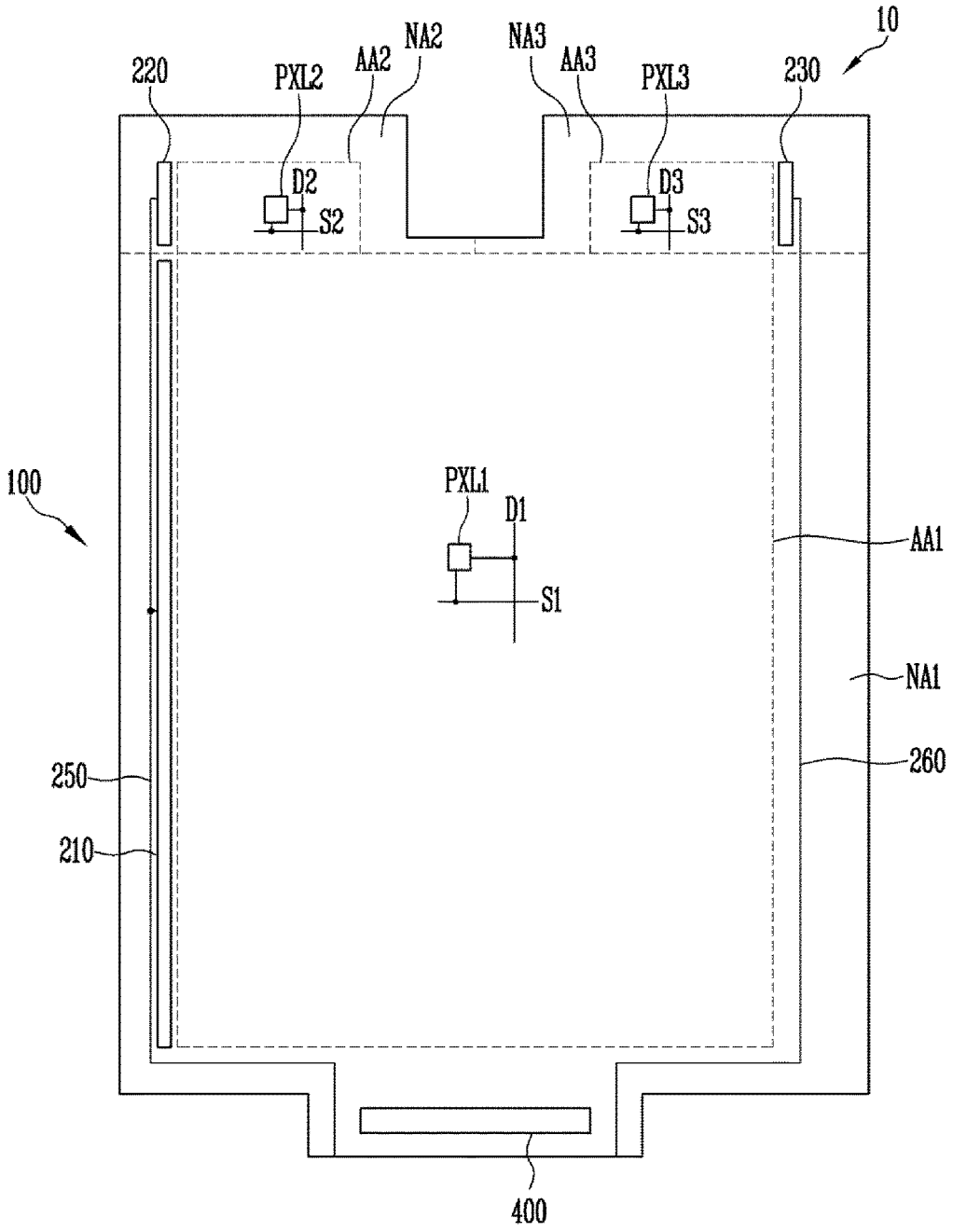
FIG. 2 illustrates an embodiment of a display device.

FIG. 2 illustrates an embodiment of a display device 10 including pixel areas AA1, AA2, and AA3 related to FIG. 1A. In another embodiment, the display device 10 may include pixel areas AA1, AA2, and AA3 related to any of FIGS. 1B to 1E.

Referring to FIG. 2, the display device 10 may include a substrate 100, first pixels PXL1, second pixels PXL2, third pixels PXL3, a first scan driver 210, a second scan driver 220, and a third scan driver 230. The first pixels PXL1 may be in the first pixel area AA1 and may be connected with a first scan line S1 and a first data line D1.

The first scan driver 210 may supply a first scan signal to the first pixels PXL1 through the first scan lines S1. For example, the first scan driver 210 may sequentially supply the first scan signal to the first scan lines S1.

The first scan driver 210 may be in a first neighboring area NA1. For example, the first scan driver 210 may be in the first neighboring area NA1 adjacent to one side (for example, a left side based on FIG. 2) of the first pixel area AA1 or may be in the first neighboring area NA1 adjacent to the other side (for example, a right side based on FIG. 2) of the first pixel area AA1. The second pixels PXL2 may be in the second pixel area AA2, and may be connected with a second scan line S2 and a second data line D2.

The second scan driver 220 may supply a second scan signal to the second pixels PXL2 through the second scan lines S2. For example, the second scan driver 220 may sequentially supply the second scan signal to the second scan lines S2.

The second scan driver 220 may be in a second neighboring area NA2. For example, the second scan driver 220 may be in the second neighboring area NA2 adjacent to one side (for example, the left side based on FIG. 2) of the second pixel area AA2, or may be in the second neighboring area NA2 adjacent to the other side (for example, the right side based on FIG. 2) of the second pixel area AA2.

The second pixel area AA2 may have a smaller area than the first pixel area AA1, so that the number of second pixels PXL2 may be less than that of the first pixels PXL1 and lengths of the second scan lines S2 may be less than the first scan lines S1. Further, the number of second pixels PXL2 connected to one second scan line S2 may be less than that of the first pixels PXL1 connected to one first scan line S1.

The third pixels PXL3 may be in the third pixel area AA3, and each of the third pixels PXL3 may be connected with a third scan line S3 and a third data line D3.

The third scan driver 230 may supply a third scan signal to the third pixels PXL3 through the third scan lines S3. For example, the third scan driver 230 may sequentially supply the third scan signal to the third scan lines S3.

The third scan driver 230 may be in a third neighboring area NA3. For example, the third scan driver 230 may be in the third neighboring area NA3 adjacent to one side (for example, a left side based on FIG. 2) of the third pixel area AA3, or may be in the third neighboring area NA3 adjacent to the other side (for example, a right side based on FIG. 2) of the third pixel area AA3.

The third pixel area AA3 may have a smaller area than that of the first pixel area AA1, so that the number of third pixels PXL3 may be less than that of the first pixels PXL1 and lengths of the third scan lines S3 may be less than those of first scan lines S1. Further, the number of third pixels PXL3 connected to one third scan line S3 may be less than that of the first pixels PXL1 connected to one first scan line S1.

The scan signal may be set with a gate-on voltage (for example, a voltage with a low level) to turn on transistors in the pixels PXL1, PXL2, and PXL3.

The first scan driver 210 and the second scan driver 220 may operate based on a first driving signal. To this end, the first signal line 250 may supply a first driving signal to the first scan driver 210 and the second scan driver 220. In this case, the first signal line 250 may be in the neighboring areas NA1 and NA2.

The third scan driver 230 may operate based on to a second driving signal. To this end, the second signal line 260 may supply a second driving signal to the third scan driver 230. In this case, the second signal line 260 may be in the neighboring areas NA1 and NA3.

The first signal line 250 and the second signal line 260 may receive the first driving signal and the second driving signal, respectively, from a separate constituent element (for example, a timing controller). The first signal line 250 and the second signal line 260 may be elongated toward the first neighboring area NA1 at a lower side of the first pixel area AA1. In one embodiment, a plurality of first signal lines 250 and a plurality of second signal lines 260 may be included, and the first driving signal and the second driving signal may be a clock signal.

The data driver 400 may supply a data signal to the pixels PXL1, PXL2, and PXL3 through data lines D1, D2, and D3. The second data lines D2 may be connected with some of the first data lines D1. The third second data lines D3 may be connected with the other of the first data lines D1. For example, the second data lines D2 may extend from some of the first data lines D1, and the third data lines D3 may extend from the other of the first data lines D1.

The data driver 400 may be in the first neighboring area NA1 and, for example, may be at a position (for example, a lower side of the first pixel area AA1 based on FIG. 2), which does not overlap the first scan driver 210. The data driver 400 may be installed by various methods, e.g., chip-on-glass, chip-on-plastic, tape carrier package, or chip-on-film. For example, the data driver 400 may be directly mounted on the substrate 100 or may be connected with the substrate 100 through a separate constituent element (for example, a flexible printed circuit board).

Figure 3:
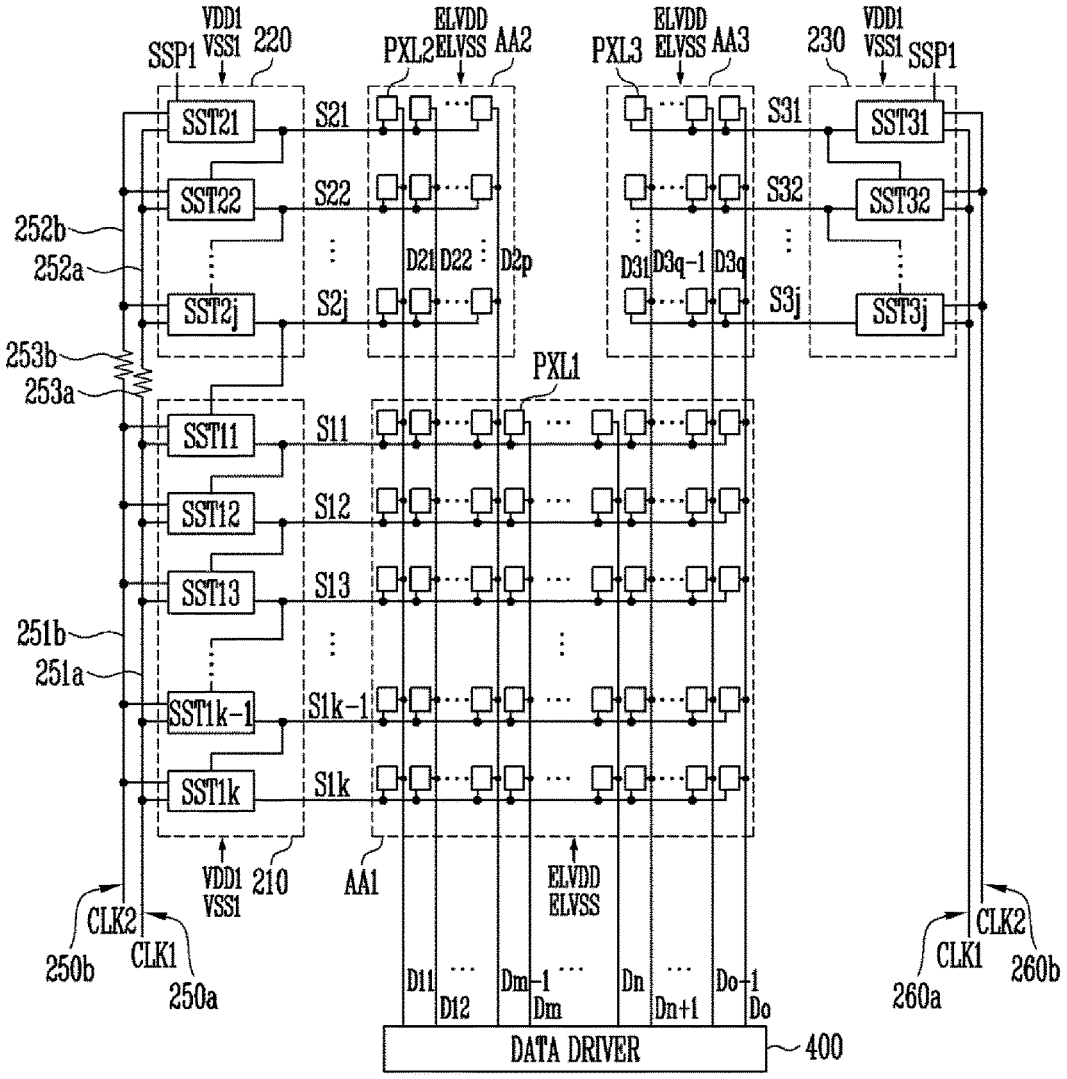
FIG. 3 illustrates an embodiment of a load matching resistor.

FIG. 3 illustrates an embodiment of a load matching resistor installed at the signal line. Referring to FIG. 3, the display device 10 may include a plurality of first signal lines 250*a* and 250*b* and a plurality of second signal lines 260*a* and 260*b* for supplying driving signals CLK1 and CLK2 to scan drivers 210, 220, and 230.

The driving signals CLK1 and CLK2 may include a first clock signal CLK1 and a second clock signal CLK2. For example, the first clock signal CLK1 and the second clock signal CLK2 may have different phases.

The first signal lines 250*a* and 250*b* may supply the clock signals CLK1 and CLK2 to the first scan driver 210 and the second scan driver 220. For example, the first first signal line 250*a* may supply the first clock signal CLK1 to the first scan driver 210 and the second scan driver 220, and the second first signal line 250*b* may supply the second clock signal CLK2 to the first scan driver 210 and the second scan driver 220.

The second signal lines 260*a* and 260*b* may supply the clock signals CLK1 and CLK2 to the third scan driver 230. For example, the first second signal line 260*a* may supply the first clock signal CLK1 to the third scan driver 230, and the second signal line 260*b* may supply the second clock signal CLK2 to the third scan driver 230.

The first scan driver 210 may be connected to first ends of the first scan lines S11 to S1*k*, and may supply the first scan signal to the first scan lines S11 to S1*k*. The first scan driver 210 may include a plurality of scan stage circuits SST11 to SST1*k*. The scan stage circuits SST11 to SST1*k* of the first scan driver 210 may be connected to one ends of the first scan lines S11 to S1*k*, respectively, and may supply the first scan signal to the first scan lines S11 to S1*k*, respectively. In this case, the scan stage circuits SST11 to SST1*k* may operate based on the clock signals CLK1 and CLK2 received, for example, from an external source. The scan stage circuits SST11 to SST1*k* may be identical circuits.

The scan stage circuits SST11 to SST1*k* may receive output signals (that is, the scan signals) or start pulses of the previous scan stage circuits. For example, the first scan stage circuit SST11 may receive a start pulse, and the remaining scan stage circuits SST12 to SST1*k* may receive output signals of the previous stages circuits.

As illustrated in FIG. 3, the first scan stage circuit SST11 of the first scan driver 210 may use a signal output from the last scan stage circuit SST2*j* of the second scan driver 220 as a start pulse. In another exemplary embodiment, the first scan stage circuit SST11 of the first scan driver 210 may not receive a signal from the last scan stage circuit SST2*j* of the second scan driver 220 and may separately receive a start pulse.

Each of the scan stage circuits SST11 to SST1*k* may receive first driving power source VDD1 and second driving power source VSS1. The first driving power source VDD1 may be set with a gate-off voltage, for example, a voltage with a high level. Further, the second driving power source VSS1 may be set with a gate-on voltage, for example, a voltage with a low level.

The first pixels PXL1 in the first pixel area AA1 may receive a data signal from the data driver 400 through the first data lines D11 to Do. The first pixels PXL1 may receive first pixel power source ELVDD and second pixel power source ELVSS. The first pixels PXL1 may receive the data signal from the first data lines D11 to Do when the first scan signal is supplied to the first scan lines S11 to S1*k*. The first pixels PXL1 receiving the data signal may control the quantity of current flowing from the first pixel power source ELVDD to the second pixel power source ELVSS through an organic light emitting diode. The number of first pixels PXL1 in one line (row or column) may be different, for example, based on positions of the first pixels PXL1.

Referring to FIG. 3, the second scan driver 220 may be connected to first ends of the second scan lines S21 to S2*j*. The second scan driver 220 may include a plurality of scan stage circuits SST21 to SST2*j*. The scan stage circuits SST21 to SST2*j* of the second scan driver 220 may be connected to first ends of the second scan lines S21 to S2*j*, respectively, and may supply the second scan signal to the second scan lines S21 to S2*j*, respectively.

The scan stage circuits SST21 to SST2*j* may operate based on the clock signals CLK1 and CLK2 supplied, for example, from an external source. The scan stage circuits SST21 to SST2*j* may be identical circuits.

The scan stage circuits SST21 to SST2*j* may receive output signals (that is, the scan signals) or start pulses SSP1 of the previous scan stage circuits. For example, the first scan stage circuit SST21 may receive a start pulse SSP1, and the remaining scan stage circuits SST22 to SST2*j* may receive output signals of previous stages circuits. The last scan stage circuit SST2*j* of the second scan driver 220 may supply the output signal to the first scan stage circuit SST11 of the first scan driver 210.

Each of the scan stage circuits SST21 to SST2*j* may receive the first driving power source VDD1 and the second driving power source VSS1. The first driving power source VDD1 may correspond to a gate-off voltage, for example, a high level voltage. The second driving power source VSS1 may correspond to gate-on voltage, for example, a low level voltage.

The second pixels PXL2 in the second pixel area AA2 may receive a data signal from the data driver 400 through the second data lines D21 to D2*p*. For example, the second data lines D21 to D2*p* may be connected with some of the first data lines D11 to Dm−1. The second pixels PXL1 may receive the first pixel power source ELVDD and the second pixel power source ELVSS.

The second pixels PXL2 may receive the data signal from the second data lines D21 to D2*p* when the second scan signal is supplied to the second scan lines S21 to S2*j*. The second pixels PXL2 receiving the data signal may control the quantity of current flowing from the first pixel power source ELVDD to the second pixel power source ELVSS through the organic light emitting diode. The number of second pixels PXL2 in one line (row or column) may be different based on positions of the second pixels PXL2.

Referring to FIG. 3, the second scan driver 230 may be connected to first ends of the third scan lines S31 to S3*j*. The third scan driver 230 may include a plurality of scan stage circuits SST31 to SST3*j*. The scan stage circuits SST31 to SST3*j* of the third scan driver 230 may be connected to first ends of the third scan lines S31 to S3*j*, respectively, and may supply the third scan signal to the third scan lines S31 to S3*j*, respectively.

The scan stage circuits SST31 to SST3*j* may operated based on the clock signals CLK1 and CLK2 supplied, for example, from an external source. The scan stage circuits SST31 to SST3*j* may be identical circuits.

The scan stage circuits SST31 to SST3*j* may receive output signals (that is, the scan signals) or the start pulses SSP1 of the previous scan stage circuits. For example, the first scan stage circuit SST31 may receive a start pulse SSP1, and the remaining scan stage circuits SST32 to SST3*j* may receive output signals of the previous stages circuits. The last scan stage circuit SST3*j* of the third scan driver 230 may supply the output signal to the first scan stage circuit SST11 of the second scan driver 212.

Each of the scan stage circuits SST31 to SST3*j* may receive the first driving power source VDD1 and the second driving power source VSS1. The first driving power source VDD1 may correspond to a gate-off voltage, for example, a high level voltage. The second driving power source VSS1 may correspond to a gate-on voltage, for example, a low level voltage.

The third pixels PXL1 in the third pixel area AA1 may receive a data signal from the data driver 400 through the third data lines D31 to D3*q*. For example, the third data lines D31 to D3*q* may be connected with some of the first data lines Dn+1 to Do. The third pixels PXL3 may receive the first pixel power source ELVDD, the second pixel power source ELVSS, and initialization power source Vint.

The third pixels PXL1 may receive the data signal from the third data lines D31 to D3*q* when the third scan signal is supplied to the third scan lines S31 to S3*j*. The third pixels PXL3 receiving the data signal may control the quantity of current flowing from the first pixel power source ELVDD to the second pixel power source ELVSS through the organic light emitting diode. The number of third pixels PXL3 in one line (row or column) may be different based on the positions of the third pixels PXL3.

Loads of the first scan lines S11 to S1*k* may be different from loads of the second scan lines S21 to S2*j*. For example, the first scan lines S11 to S1*k* may be longer than the second scan lines S21 to S2*j*, and the number of first pixels PXL1 may be greater than the number of second pixels PXL2, so that loads of the first scan lines S11 to S1*k* may be larger than the loads of the second scan lines S21 to S2*j*.

Capacitance of the first scan lines S11 to S1*k* may be larger than that of the second scan lines S21 to S2*j*. This causes a difference in a time constant between the first scan signal and the second scan signal. The difference may cause a brightness difference between the first pixels PXL1 and the second pixels PXL2.

According to the present exemplary embodiment, the load matching resistors 253*a* and 253*b* may therefore be installed in the first signal lines 250*a* and 250*b*. Accordingly, it is possible to match the loads of the first scan lines S11 to S1*k* and the second scan lines S21 to S2*j*, and brightness of the first pixel area AA1 and the second pixel area AA2 may be uniform.

For example, the first first signal line 250*a* may include a first sub signal line 251*a*, a second sub signal line 252*a*, and a first load matching resistor 253*a*. The first sub signal line 251*a* may be connected with the first scan driver 210, and may supply the first clock signal CLK1 to the first scan driver 210. The second sub signal line 252*a* may be connected with the second scan driver 220, and may supply the first clock signal CLK1 to the second scan driver 220.

The first load matching resistor 253*a* may be connected between the first sub signal line 251*a* and the second sub signal line 252*a*. One end of the first sub signal line 251*a* may receive the first clock signal CLK1. The other end of the first sub signal line 251*a* may be connected to the first load matching resistor 253*a*.

Accordingly, the first sub signal line 251*a* may receive the first clock signal CLK1 and may transmit the first clock signal CLK1 to the second sub signal line 252*a* through the first load matching resistor 253*a*.

The second first signal line 250*b* may include a first sub signal line 251*b*, a second sub signal line 252*b*, and a first load matching resistor 253*b*, identically to the first first signal line 250*a*. The first sub signal line 251*b* may be connected with the first scan driver 210, and may supply the second clock signal CLK2 to the first scan driver 210. The second sub signal line 252*b* may be connected with the second scan driver 220, and may supply the second clock signal CLK2 to the second scan driver 220.

The first load matching resistor 253*b* may be connected between the first sub signal line 251*b* and the second sub signal line 252*b*. One end of the first sub signal line 251*b* may receive the second clock signal CLK2. The other end of the first sub signal line 251*b* may be connected to the first load matching resistor 253*b*.

Accordingly, the first sub signal line 251*b* may receive the second clock signal CLK2 and may transmit the second clock signal CLK2 to the second sub signal line 252*b* through the first load matching resistor 253*b*.

The first load matching resistors 253*a* and 253*b* may be connected between the first scan stage circuit SST11 of the first scan driver 210 and the last scan stage circuit SST2*j* of the second scan driver 220.

Figure 4:
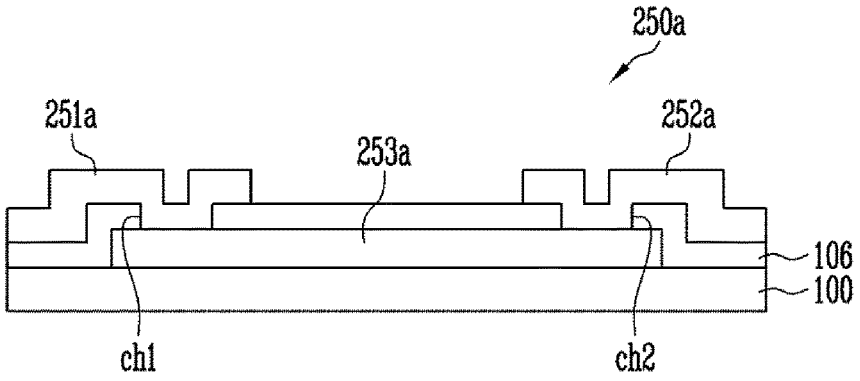
FIG. 4 illustrates an embodiment of a first signal line.

FIG. 4 illustrates, in cross-section, an embodiment of the first signal line, e.g., the first first signal line 250*a*. Referring to FIG. 4, the first load matching resistor 253*a* may be on the substrate 100. An insulating layer 106 may be at an upper side of the first load matching resistor 253*a*. The first sub signal line 251 and the second sub signal line 252*a* may be at an upper side of the insulating layer 106. In this case, the first sub signal line 251*a* and the second sub signal line 252*a* may be connected with the first load matching resistor 253*a* through contact holes ch1 and ch2 in the insulating layer 106, respectively.

The first load matching resistor 253*a* may be formed of a material having higher resistance than those of the first sub signal line 251 and the second sub signal line 252*a*. For example, the first load matching resistor 253*a* may be formed of the same material as that of the gate electrodes or semiconductor layers of the transistors included in the pixels PXL1, PXL2, and PXL3. Further, the first sub signal line 251*a* and the second sub signal line 252*a* may be formed of the same material as those of source and drain electrodes of the transistors included in the pixels PXL1, PXL2, and PXL3.

For convenience of the description, FIG. 4 illustrates the first first signal line 250*a*, but the second first signal line 250*b* may also have the same structure as that of the first first signal line 250*a*

Figure 5:
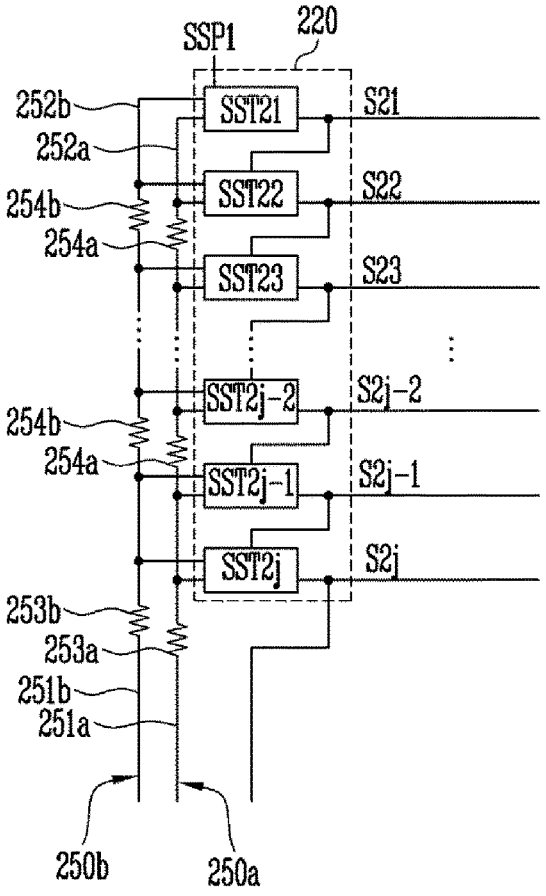
FIG. 5 illustrates an embodiment of a first signal line and a second scan driver.

FIG. 5 illustrates an embodiment of the first signal line and the second scan driver. Referring to FIG. 5, one or more additional load matching resistors 254*a* and 254*b* may be installed in the second sub signal lines 252*a* and 252*b* in the first signal lines 250*a* and 250*b*.

The loads of the second scan lines S21 to S2*j* may be different from each other. For example, the lengths of the second scan lines S21 to S2*j* may be different from each other according to the form of the second pixel area AA2. The number of pixels PXL2 connected to each of the second scan lines S21 to S2*j* may be different.

In this case, the load matching resistors 254*a* and 254*b* may be additionally required for matching the loads of the second scan lines S21 to S2*j*. To this end, each of the second sub signal lines 252*a* and 252*b* may be separated into a plurality of signal lines, and the load matching resistors 254*a* and 254*b* may be connected between the separated signal lines.

The load matching resistors 254*a* and 254*b* may be connected between the adjacent two stage circuits (for example, the stage circuits SST22 and SST23, and the stage circuits SST2*j*−2 and SST2*j*−1). The load matching resistors 254*a* and 254*b* may have, for example, the same material and structure as those of the first load matching resistor 253*a* described with reference to FIG. 4.

The present description is based on the second sub signal lines 252*a* and 252*b* in the first signal lines 250*a* and 250*b*, but the additional load matching resistor may also be installed in the first sub signal lines 251*a* and 251*b* in first signal lines 250*a* and 250*b*.

Figure 6:
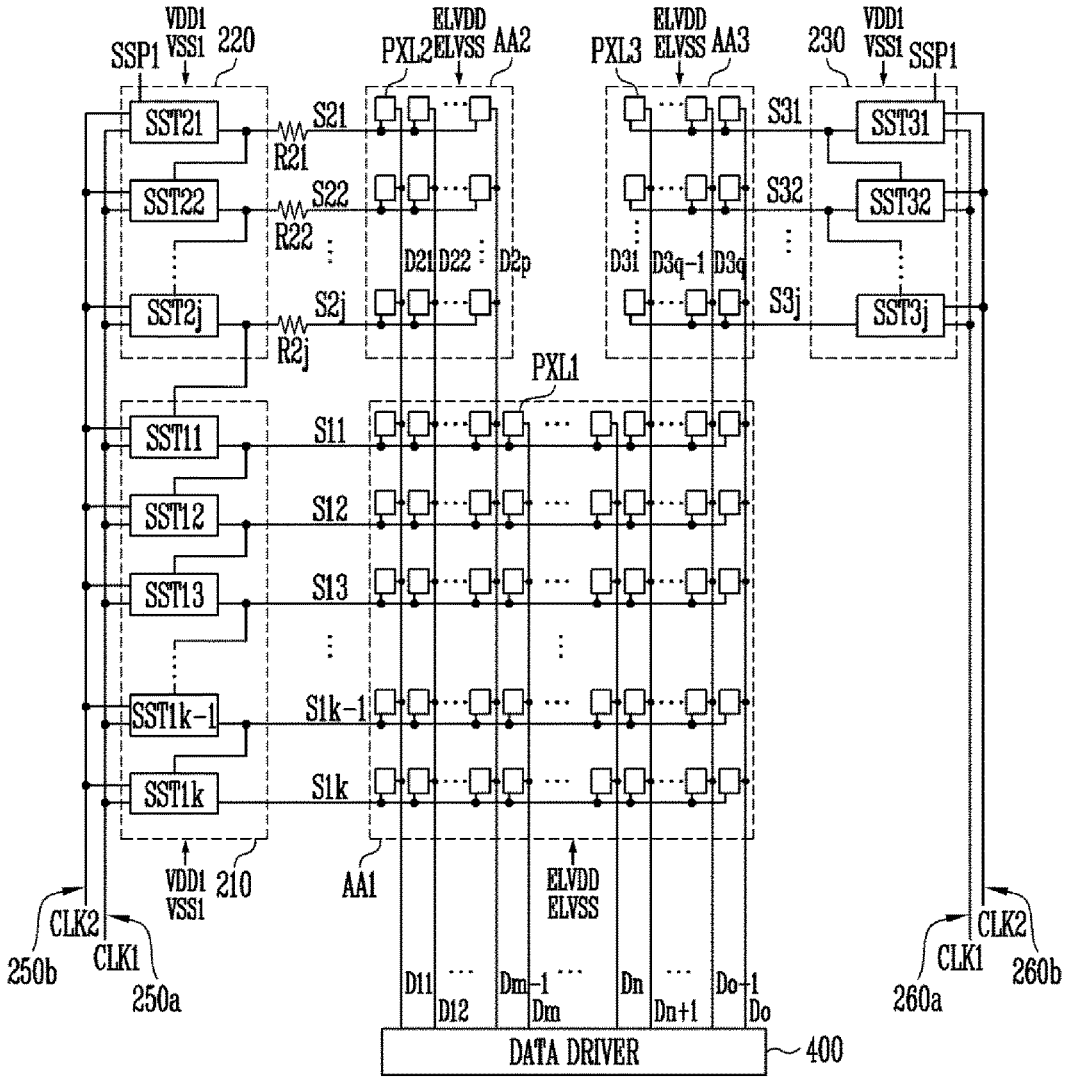
FIG. 6 illustrates an embodiment of load matching resistors.

FIG. 6 illustrates an embodiment of a load matching resistor, which, for example, may be installed at the signal lines. In order to match the loads of the first scan lines S11 to S1*k* and the second scan lines S21 to S2*j*, first load matching resistors R21 to R2*j* may be installed in the second scan lines S21 to S2*j*. The first load matching resistors R21 to R2*j* may be connected between the second scan driver 20 and the second scan lines S21 to S2*j*.

The first load matching resistors R21 to R2*j* may have the same resistance value or different resistance values. For example, at least some of the second scan lines S21 to S2*j* may have different loads, so that at least some of the first load matching resistors R21 to R2*j* for some of the second scan lines S21 to S2*j* may have different resistance values. For example, the first load matching resistors R21 to R2*j* may be connected between output terminals of the scan stage circuits SST21 to SST2*j* in the second scan driver 20 and the second scan lines S21 to S2*j*.

The first load matching resistors R21 to R2*j* may be formed of a material having higher resistance than that of the second scan lines S21 to S2*j*. For example, the second scan lines S21 to S2*j* may be formed of the same material as those of the source and drain electrodes of the transistors in the pixels PXL1, PXL2, and PXL3. The first load matching resistors R21 to R2*j* may be formed of the same material as the gate electrodes or the semiconductor layers of the transistors in the pixels PXL1, PXL2, and PXL3.

Further, the second scan lines S21 to S2*j* may be formed of the same material as the gate electrodes of the transistors in the pixels PXL1, PXL2, and PXL3. The first load matching resistors R21 to R2*j* may be formed of the same material as the semiconductor layers of the transistors in the pixels PXL1, PXL2, and PXL3.

Figure 7:
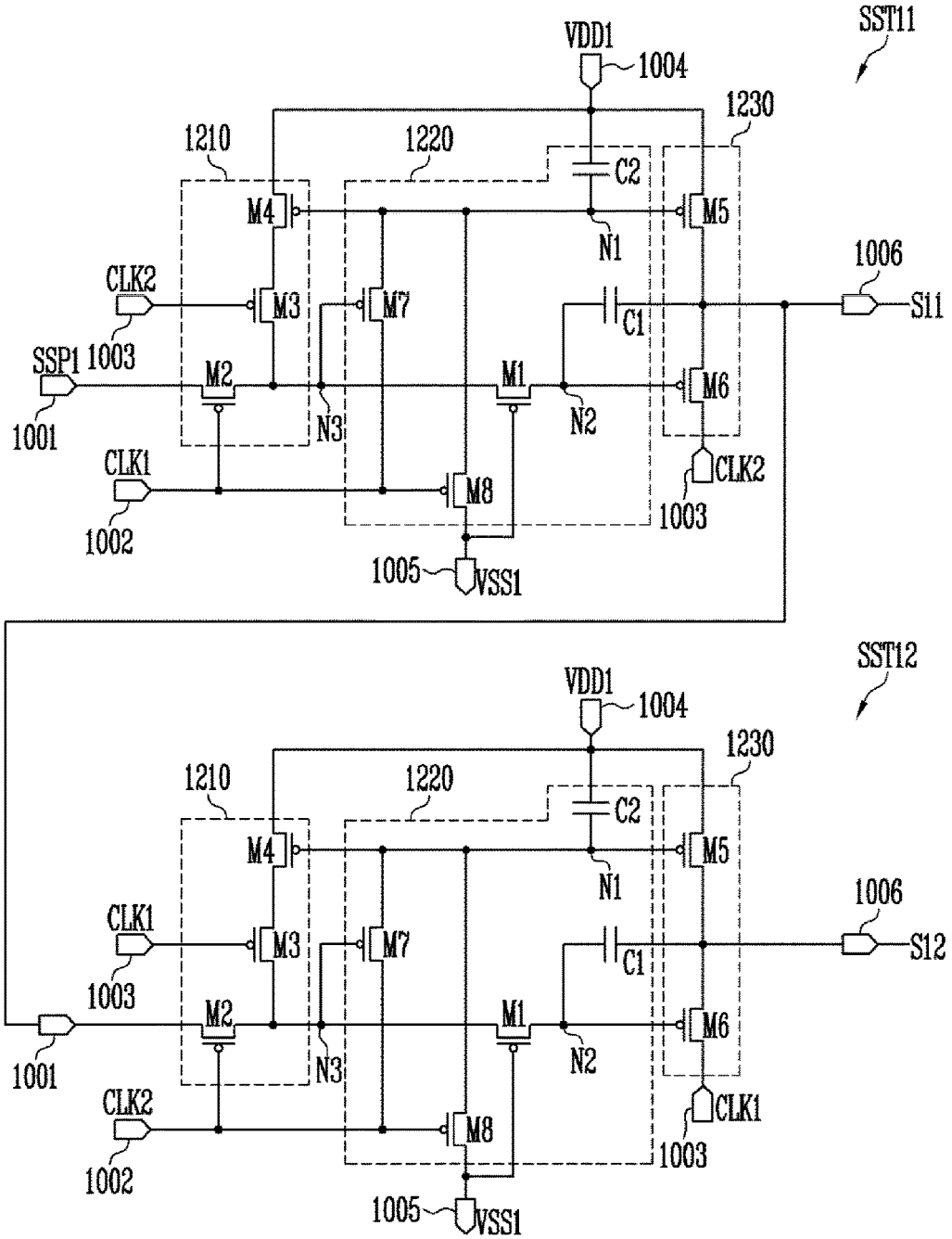
FIG. 7 illustrates an embodiment of a scan stage circuit.

FIG. 7 illustrates an embodiment of a scan stage circuit, which, for example, may correspond to FIG. 3. The scan stage circuits SST11 and SST12 of the first scan driver 210 as representative examples.

Referring to FIG. 7, the first scan stage circuit SST11 may include a first driving circuit 1210, a second driving circuit 1220, and an output unit 1230. The output unit 1230 may control a voltage supplied to an output terminal 1006 based on voltages of a first node N1 and a second node N2. The output unit 1230 may include a fifth transistor M5 and a sixth transistor M6.

The fifth transistor M5 may be connected between a fourth input terminal 1004, to which the first driving power source VDD1 is input, and the output terminal 1006. A gate electrode of the fifth transistor M5 may be connected to the first node N1. The first transistor M5 may control a connection of the fourth input terminal 1004 and the output terminal 1006 based on a voltage applied to the first node N1.

The sixth transistor M6 may be connected between the output terminal 1006 and a third input terminal 1003. A gate electrode of the sixth transistor M6 may be connected to a second node N2. The sixth transistor M6 may control a connection of the output terminal 1006 and the third input terminal 1003 based on a voltage applied to the second node N2.

The output unit 1230 may be driven as a buffer. Additionally, a plurality of transistors connected in parallel may replace the fifth transistor M5 and/or the sixth transistor M6 in one embodiment.

The first driving circuit 1210 may control a voltage of the third node N3 based on signals supplied to the first input terminal 1001 to the third input terminal 1003. To this end, the first driving circuit 1210 may include a second transistor M2 to a fourth transistor M4. The second transistor M2 may be connected between the first input terminal 1001 and a third node N3, and a gate electrode thereof may be connected to a second input terminal 1002. The second transistor M2 may control a connection of the first input terminal 1001 and the third node N3 based on a signal supplied to the second input terminal 1002.

The third transistor M3 and the fourth transistor M4 may be serially connected between the third node N3 and the fourth input terminal 1004. In one embodiment, the third transistor M3 may be connected between the fourth transistor M4 and the third node N3, and a gate electrode thereof may be connected to the third input terminal 1003. The third transistor M3 may control a connection of the fourth transistor M4 and the third node N3 based on a signal supplied to the third input terminal 1003.

The fourth transistor M4 may be connected between the third transistor M3 and a fourth input terminal 1004, and a gate electrode thereof may be connected to the first node N1. The fourth transistor M4 may control a connection of the third transistor M3 and the fourth input terminal 1004 based on a voltage applied to the first node N1.

The second driving circuit 1220 may control a voltage of the first node N1 based on the voltages of the second input terminal 1002 and the third node N3. To this end, the second driving circuit 1220 may include a first transistor M1, a seventh transistor M7, an eighth transistor M8, a first capacitor C1, and a second capacitor C2.

The first capacitor C1 may be connected between the second node N2 and the output terminal 1006. The first capacitor C1 charges a voltage corresponding to turn-on and turn-off of the sixth transistor M6.

The second capacitor C2 may be connected between the first node N1 and the fourth input terminal 1004. The second capacitor C2 may charge a voltage applied to the first node N1.

The seventh transistor M7 may be connected between the first node N1 and the second input terminal 1002, and a gate electrode thereof may be connected to the third node N3. The seventh transistor M7 may control a connection of the first node N1 and the second input terminal 1002 based on a voltage applied to the third node N3.

The eighth transistor M8 may be between the first node N1 and a fifth input terminal 1005, to which the second driving power source VSS1 is supplied, and a gate electrode thereof may be connected to the second input terminal 1002. The eighth transistor M8 may control a connection of the first node N1 and the fifth input terminal 1005 based on a signal supplied to the second input terminal 1002.

The first transistor M1 may be connected between the third node N3 and the second node N2, and a gate electrode thereof may be connected to the fifth input terminal 1005. The first transistor M1 may maintain an electrical connection of the third node N3 and the second node N2 while maintaining a turn-on state. In addition, the first transistor M1 may restrict a voltage drop width of the third node N3 based on a voltage of the second node N2. For example, even though the voltage of the second node N2 is dropped to a voltage lower than that of the second driving power source VSS1, the voltage of the third node N3 is not decreased below the voltage, which may be obtained by subtracting a threshold voltage of the first transistor M1 from the second driving power source VSS1.

The second scan stage circuit SST12 and remaining scan stage circuits SST13 to SST1*k* may have the same configuration as that of the first scan stage circuit SST11.

Further, the second input terminal 1002 of the $j^{th}$ (j is an odd number or an even number) scan stage circuit SST1*j* may receive the first clock signal CLK1, and the third input terminal 1003 thereof may receive the second clock signal CLK2. The second input terminal 1002 of the j+1$^{th}$ scan stage circuit SST1*j*+1 may receive the second clock signal CLK2, and the third input terminal 1003 thereof may receive the first clock signal CLK1.

The first clock signal CLK1 and the second clock signal CLK2 have the same cycle and phases thereof do not overlap each other. For example, when a period of the supply of the scan signal to one first scan line S1 is referred to as a 1 horizontal period (1H), each of the clock signals CLK1 and CLK2 may have a cycle of 2H and may be supplied during different horizontal periods.

The stage circuit in the first scan driver 210 is mainly described with reference to FIG. 7, but the stage circuits in other scan drivers (for example, the second scan driver 220 and the third scan driver 230), other than the first scan driver 210, may have the same configuration.

Figure 8:
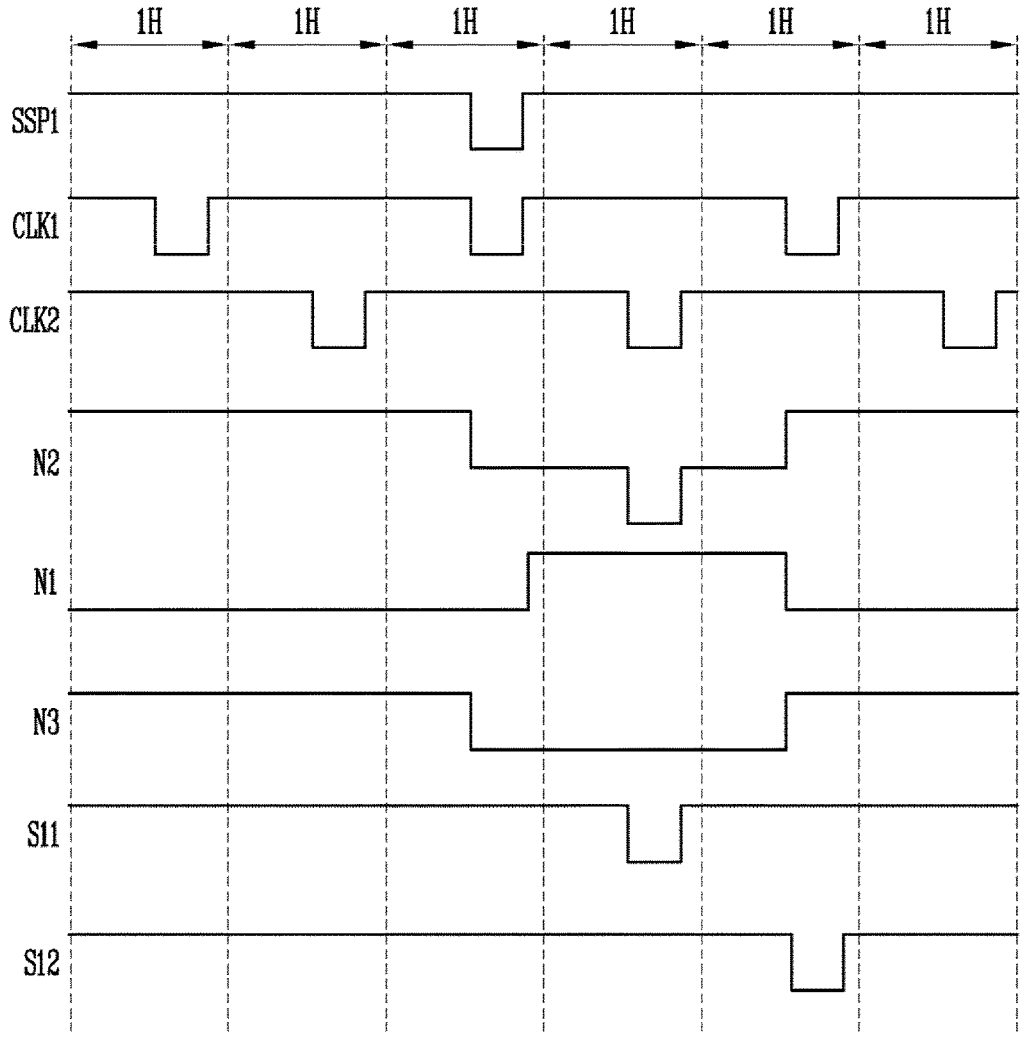
FIG. 8 illustrates an embodiment of a method for driving a scan stage circuit.

FIG. 8 is a waveform diagram illustrating an embodiment of a method for driving the scan stage circuit in FIG. 7. For convenience of the description, in FIG. 8, an operation process will be described using the first scan stage circuit SST11.

Referring to FIG. 8, the first clock signal CLK1 and the second clock signal CLK2 may have a cycle of 2 horizontal periods (2H), and may be supplied during different horizontal periods. For example, the second clock signal CLK2 may be a signal shifted by a half cycle (that is, a 1 horizontal period) from the first clock signal CLK1. Further, the first start pulse SSP1 supplied to the first input terminal 1001 is supplied to be synchronized with the clock signal, that is, the first clock signal CLK1, supplied to the second input terminal 1002.

In addition, when the first start pulse SSP is supplied, the first input terminal 1002 may be set with the voltage of the second driving power source VSS1. When the first start pulse SSP is not supplied, the first input terminal 1002 may receive the voltage of the first driving power source VDD1. Further, when the clock signals CLK1 and CLK2 are supplied to the second input terminal 1002 and the third input terminal 1003, the second input terminal 1002 and the third input terminal 1003 may be receive the voltage of the second driving power source VSS1. When the clock signals CLK1 and CLK2 are not supplied to the second input terminal 1002 and the third input terminal 1003, the second input terminal 1002 and the third input terminal 1003 may receive the voltage of the first driving power source VDD1.

In operation, first, the first start pulse SSP1 is supplied to be synchronized with the first clock signal CLK1. When the first clock signal CLK1 is supplied, the second transistor M2 and the eighth transistor M8 may be turned on. When the second transistor M2 is turned on, the first input terminal 1001 and the third node N3 are electrically connected. Since the first transistor M1 is always set in a turn-on state, the second node may maintain an electrical connection with the third node N3.

When the first input terminal 1001 and the third node N3 are electrically connected, the third node N3 and the second node N2 may be set with a voltage at a low level by the first start pulse SSP supplied to the first input terminal 1001. When the third node N3 and the second node N2 are set with the voltage at the low level, the sixth transistor M6 and the seventh transistor M7 may be turned on.

When the sixth transistor M6 is turned on, the third input terminal 1003 and the output terminal 1006 may be electrically connected. The third input terminal 1003 may be set with a voltage at a high level (that is, the second clock signal CLK2 is not supplied). Thus, the voltage with the high level may also be output to the output terminal 1006. When the seventh transistor M7 is turned on, the second input terminal 1002 and the first node N1 may be electrically connected. Then, the voltage of the first clock signal CLK1 supplied to the second input terminal 1002, that is, the voltage with the low level, may be supplied to the first node N1.

In addition, when the first clock signal CLK1 is supplied, the eighth transistor M8 may be turned on. When the eighth transistor M8 is turned on, the voltage of the second driving power source VSS1 is supplied to the first node N1. The voltage of the second driving power source VSS1 may be set with the voltage which is the same as (or similar to) the first cock signal CLK1. Thus, the first node N1 may stably maintain the voltage with the low level.

When the first node N1 is set with the voltage with the low level, the fourth transistor M4 and the fifth transistor M5 may be turned on. When the fourth transistor M4 is turned on, the fourth input terminal 1004 and the third transistor M3 may be electrically connected. Since the third transistor M3 is set in the turn-off state, even though the fourth transistor M4 is turned on, the third node N3 may stably maintain the voltage at the low level.

When the fifth transistor M5 is turned on, the voltage of the first driving power source VDD1 is supplied to the output terminal 1006. The voltage of the first driving power source VDD1 may be set with the voltage which is the same as the voltage at the high level supplied to the third input terminal 1003. Thus, the output terminal 1006 may stably maintain the voltage at the high level.

Then, the supply of the first start signal SSP1 and the first clock signal CLK1 may be stopped. When the supply of the first clock signal CLK1 is stopped, the second transistor M2 and the eighth transistor M8 may be turned off. In this case, the sixth transistor M6 and the seventh transistor M7 may maintain the turn-on stage based on the voltage stored in the first capacitor C1. For example, the second node N2 and the third node N3 maintain the voltage with the low level by the voltage in the first capacitor C1.

When the sixth transistor M6 maintains the turn-on state, the output terminal 1006 and the third input terminal 1003 may maintain an electrical connection. When the seventh transistor M7 maintains the turn-on state, the first node N1 may maintain an electrical connection with the second input terminal 1002. The voltage of the second input terminal 1002 may be set with the voltage at the high level based on the stop of the supply of the first clock signal CLK1. Thus, the first node N1 may also be set with the voltage at the high level. When the voltage with the low level is supplied to the first node N1, the fourth transistor M4 and the fifth transistor M5 may be turned off.

Then, the second clock signal CLK2 may be supplied to the third input terminal 1003. Since the sixth transistor M6 is set in the turn-on state, the second clock signal CLK2 supplied to the third input terminal 1003 may be supplied to the output terminal 1006. In this case, the output terminal 1006 may output the second clock signal LCK2 to the first first scan line S11 as the scan signal.

When the second clock signal CLK2 is supplied to the output terminal 1006, the voltage of the second node N2 is dropped to a voltage lower than that of the second driving power source VSS1 by a coupling of the first capacitor C1. Thus, the sixth transistor M6 may stably maintain the turn-on state. Even though the voltage of the second node N2 is dropped, the third node N3 maintain about the voltage of the second driving power source VSS1 (in actual, a voltage obtained by subtracting the threshold voltage of the first transistor M1 from the second driving power source VSS1).

After the scan signal is output to the first first scan line S11, the supply of the second clock signal CLK2 may be stopped. When the supply of the second clock signal CLK2 is stopped, the output terminal 1006 may output the voltage at the high level. Then, the voltage of the second node N2 may be increased to the voltage of the second driving power source VSS1 based on the voltage with the high level.

Then, the first clock signal CLK1 may be supplied. When the first clock signal CLK1 is supplied, the second transistor M2 and the eighth transistor M8 may be turned on. When the second transistor M2 is turned on, the first input terminal 1001 and the third node N3 may be electrically connected. In this case, the first start pulse SSP1 is not supplied to the first input terminal 1001. Thus, the first input terminal 1001 may be set with the voltage at the high level. Accordingly, when the first transistor M1 is turned on, the voltage at the high level may be supplied to the third node N3 and the second node N2, and thus, the sixth transistor M6 and the seventh transistor M7 may be turned off.

When the eighth transistor M8 is turned on, the second driving power source VSS1 is supplied to the first node N1. Thus, the fourth transistor M4 and the fifth transistor M5 may be turned on. When the fifth transistor M5 is turned on, the voltage of the first driving power source VDD1 may be supplied to the output terminal 1006. Then, the fourth transistor M4 and the fifth transistor M5 maintain the turn-on state based on the voltage charged in the second capacitor C2. Thus, the output terminal 1006 may stably receive the voltage of the first driving power source VDD1.

In additional, when the second clock signal CLK2 is supplied, the third transistor M3 may be turned on. In this case, since the fourth transistor M4 is set in the turn-on state, the voltage of the first driving power source VDD1 may be supplied to the third node N3 and the second node N2. In this case, the sixth transistor M6 and the seventh transistor M7 may stably maintain the turn-off state.

The second scan stage circuit SST12 may receive the output signal (that is, the scan signal) of the first scan stage circuit SST11 synchronized with the second clock signal CLK2. In this case, the second scan stage circuit SST12 may output the scan signal to the second first scan line S12 synchronized with the first clock signal CLK1. In one embodiment, the scan stage circuits SST may sequentially output the scan signal to the scan lines while repeating the aforementioned process.

The first transistor M1 restricts a voltage drop width of the third node N3 regardless of the voltage of the second node N2. Thus, it is possible to decrease manufacturing costs and secure driving reliability.

Figure 9:
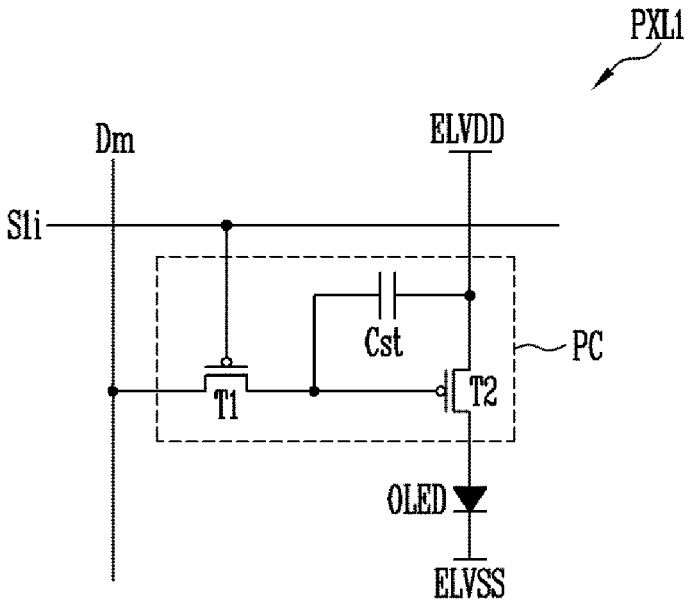
FIG. 9 illustrates an embodiment of a first pixel.

FIG. 9 illustrates an embodiment of the first pixel in FIG. 3. For convenience of the description, the first pixel PXL1 connected to the $m^{th}$ data line Dm and the $i^{th}$ first scan line S1*i* is illustrated.

Referring to FIG. 9, the first pixel PXL1 may include an organic light emitting diode OLED, a data line Dm, and a pixel circuit PC connected to the scan line S1*i* to control the organic light emitting diode OLED. An anode electrode of the organic light emitting diode OLED is connected to the pixel circuit PC. A cathode electrode is connected to a second power source ELVSS. The organic light emitting diode OLED may generate light with predetermined brightness based on a current supplied from the pixel circuit PC.

The pixel circuit PC may store the data signal supplied to the data line Dm when the scan signal is supplied to the scan line S1*i*, and may control the quantity of current supplied to the organic light emitting diode OLED based on the stored data signal. For example, the pixel circuit PC may include a first transistor T1, a second transistor T2, and a storage capacitor Cst.

The first transistor T1 may be connected between the data line Dm and the second transistor T2. For example, in the first transistor T1, a gate electrode may be connected to the scan line S1*i*, a first electrode may be connected to the data line Dm, and the second electrode may be connected to a gate electrode of the second transistor T2. The first transistor T1 is turned on when a scan signal is supplied to the scan line S1*i* to supply the data signal from the data line Dm to the storage capacitor Cst. In this case, the storage capacitor Cst may charge a voltage corresponding to the data signal.

The second transistor T2 may be connected between the first pixel power source ELVDD and the organic light emitting diode OLED. For example, in the second transistor T2, the gate electrode may be connected to a first electrode of the storage capacitor Cst and the second electrode of the first transistor T1, a first electrode may be connected to a second electrode of the storage capacitor Cst and the first pixel power source ELVDD, and a second electrode may be connected to the anode electrode of the organic light emitting diode OLED.

The second transistor T2, which serves as a driving transistor, may control the quantity of current flowing from the first pixel power source ELVDD to the second pixel power source ELVSS via the organic light emitting diode OLED based on a voltage value stored in the storage capacitor Cst. The organic light emitting diode OLED may generate light corresponding to the quantity of current from the second transistor T2.

The first electrodes of the transistors T1 and T2 may be a source electrode or a drain electrode. The second electrodes of the transistors T1 and T2 may be the other of the source electrode or drain electrode. For example, when the first electrode is a source electrode, the second electrode is a drain electrode.

The second pixel PXL2 and the third pixel PXL3 may be implemented with the same circuit as first pixel PXL1. Further, the pixel structure described with reference to FIG. 9 corresponds to one example using the scan line. In one embodiment, the pixel may have a circuit structure for supplying current to the organic light emitting diode OLED.

The organic light emitting diode OLED may generate various colors of light (e.g., red, green, blue) based on the quantity of current from the driving transistor. In one embodiment, the organic light emitting diode OLED may generate white light based on the quantity of current from the driving transistor. In this case, it is possible to implement a color image using color filters.

Figure 10:
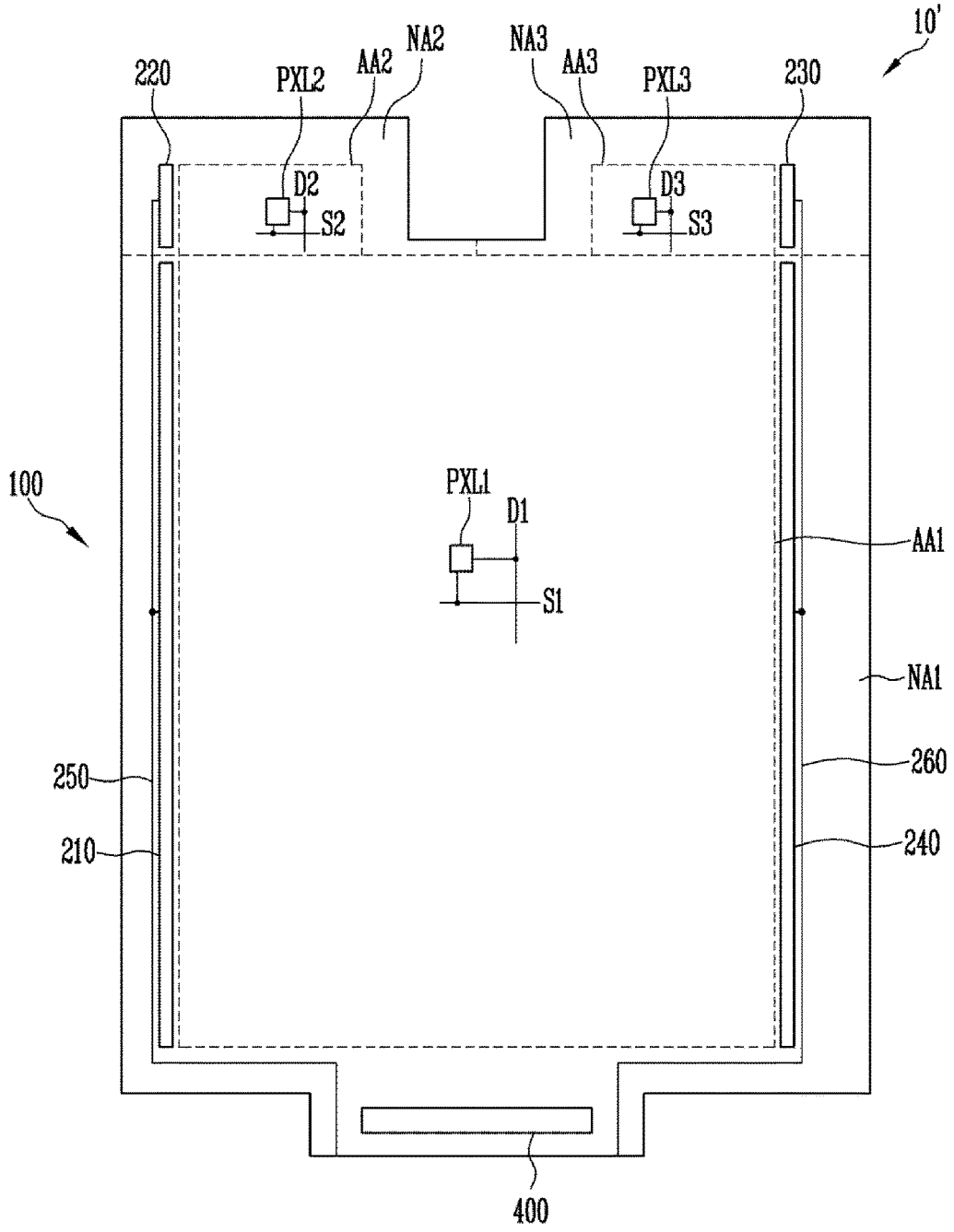
FIG. 10 illustrates another embodiment of a display device.

FIG. 10 illustrates another embodiment of a display device 10' which includes a fourth scan driver 240. The fourth scan driver 240 may be in a first neighboring area NA1 to supply a first scan signal to first scan lines S1. For example, a first scan driver 210 may be in the first neighboring area NA1 adjacent to one side (for example, a left side) of the first pixel area AA1. The fourth scan driver 240 may be in a second neighboring area NA2 adjacent to the other side (for example, a right side) of the first pixel area AA1. The first scan driver 210 and the fourth scan driver 240 may drive at least some of the first scan lines S1. One of the first scan driver 210 or the fourth scan driver 240 may be omitted. A second signal line 260 may supply a second driving signal to a third scan driver 230 and the fourth scan driver 240.

Figure 11:
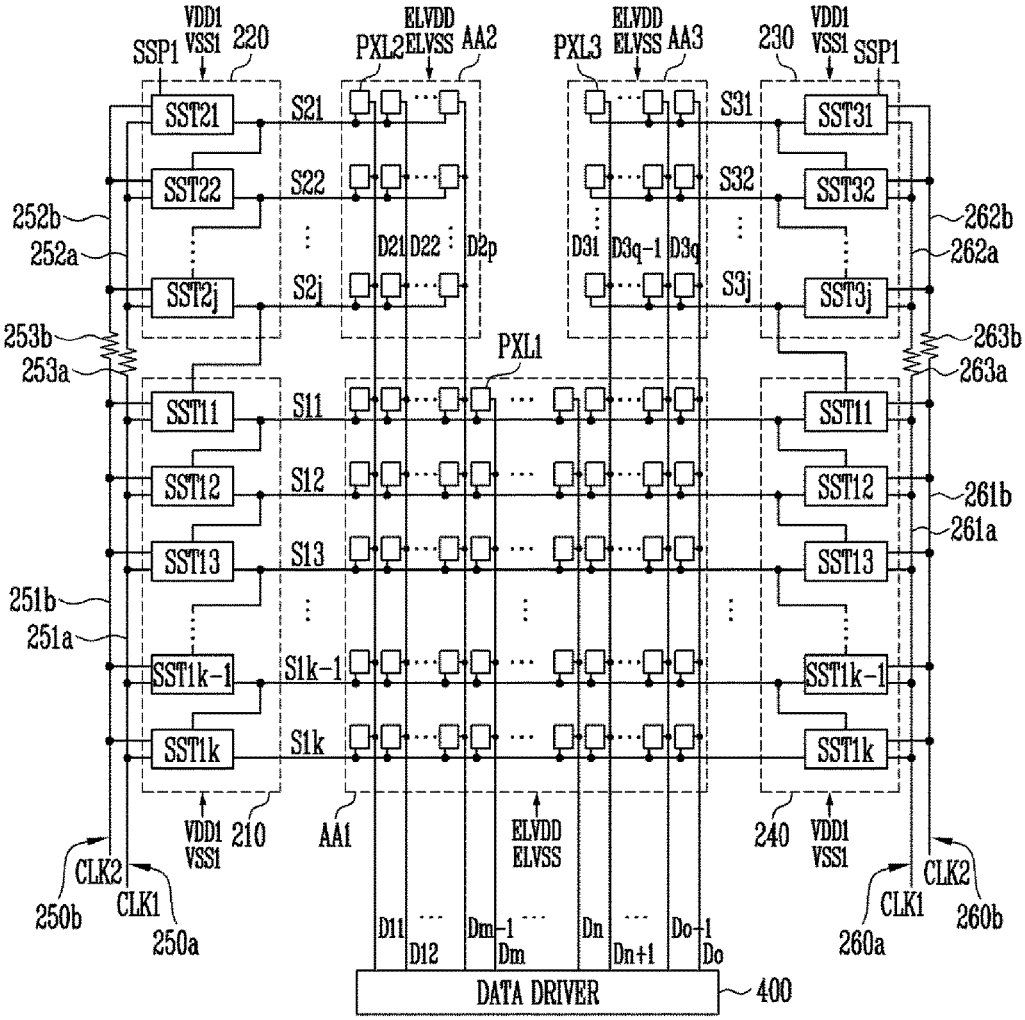
FIG. 11 illustrates an embodiment of a load matching resistor.

FIG. 11 illustrates an embodiment of a load matching resistor at a signal line. A display device 10 related to FIG. 11 may includes the fourth scan driver 240.

Referring to FIG. 11, a first scan driver 210 may be connected to first ends of first scan lines S11 to S1*k*. The fourth scan driver 240 may be connected to the second ends of the first scan lines S11 to S1*k*. For example, the first scan lines S11 to S1*k* may be connected between the first scan driver 210 and the fourth scan driver 240.

In order to prevent delay of a scan signal, the first scan driver 210 and the fourth scan driver 240 may simultaneously supply a first scan signal to the same scan line. For example, the first first scan line S11 may receive the first scan signal from the first scan driver 210 and the fourth scan driver 240 at the same time, and then the second first scan line S12 may receive the first scan signal from the first scan driver 210 and the fourth scan driver 240 at the same time. As described above, the first scan driver 210 and the fourth scan driver 240 may sequentially supply the first scan signal to the first scan lines S11 to S1*k*.

The fourth scan driver 240 may include a plurality of scan stage circuits SST11 to SST1*k*. The scan stage circuits SST11 to SST1*k* of the fourth scan driver 240 may be connected to the second ends of the first scan lines S11 to S1*k*, respectively, and may supply the first scan signal to the first scan lines S11 to S1*k*, respectively. The scan stage circuits SST11 to SST1*k* of the fourth scan driver 240 may have the same or similar configuration as first scan driver 210.

Second signal lines 260*a* and 260*b* may supply clock signals CLK1 and CLK2 to the third scan driver 230 and the fourth scan driver 240. For example, the first second signal line 260*a* may supply the first clock signal CLK1 to the third scan driver 230 and the fourth scan driver 240. The second second signal line 260*b* may supply the second clock signal CLK2 to the third scan driver 230 and the fourth scan driver 240.

Loads of the first scan lines S11 to S1*k* may be different from loads of the third scan lines S31 to S3*j*. For example, the first scan lines S11 to S1*k* may be longer than the third scan lines S31 to S3*j*, and the number of first pixels PXL1 may be greater than the number of the third pixels PXL3, so that the loads of the first scan lines S11 to S1*k* may be greater than the loads of the third scan lines S31 to S3*j*. Accordingly, like the first signal lines 250*a* and 250*b*, load matching resistors 263*a* and 263*b* may be installed in the second signal lines 260*a* and 260*b*. Accordingly, it is possible to match the loads of the first scan lines S11 to S1*k* and the third scan lines S31 to S3*j*, and brightness of the first pixel area AA1 and the third pixel area AA3 may be uniform.

The first second signal line 260*a* may include, for example, a first sub signal line 261*a*, a second sub signal line 262*a*, and a second load matching resistor 263*a*. The first sub signal line 261*a* may be connected with the fourth scan driver 240, and may supply the first clock signal CLK1 to the fourth scan driver 240. The second sub signal line 262*a* may be connected with the third scan driver 230, and may supply the first clock signal CLK1 to the third scan driver 230. The second load matching resistor 263*a* may be connected between the first sub signal line 261*a* and the second sub signal line 262*a*.

One end of the first sub signal line 261*a* may receive the first clock signal CLK1. The other end of the first sub signal line 261*a* may be connected to the second load matching resistor 263*a*. Accordingly, the first sub signal line 261*a* may receive the first clock signal CLK1, and may transmit the first clock signal CLK1 to the second sub signal line 262*a* through the second load matching resistor 263*a*.

The second second signal line 260*b* may include a first sub signal line 261*b*, a second sub signal line 262*b*, and a second load matching resistor 263*b*, identically to the first second signal line 260*a*. The first sub signal line 261*b* may be connected with the fourth scan driver 240, and may supply the second clock signal CLK2 to the fourth scan driver 240. The second sub signal line 262*b* may be connected with the third scan driver 230, and may supply the second clock signal CLK2 to the third scan driver 230.

The second load matching resistor 263*b* may be connected between the first sub signal line 261*b* and the second sub signal line 262*b*. One end of the first sub signal line 261*b* may receive the second clock signal CLK2. The other end of the first sub signal line 261*b* may be connected to the second load matching resistor 263*b*. Accordingly, the first sub signal line 261*b* may receive the second clock signal CLK2, and may transmit the second clock signal CLK2 to the second sub signal line 262*b* through the second load matching resistor 263*b*.

The second load matching resistors 263*a* and 263*b* may be connected between the first scan stage circuit SST11 of the fourth scan driver 240 and the last scan stage circuit SST3*j* of the third scan driver 230. The second signal lines 260*a* and 260*b* may have the same material and structure, for example, as those of the first signal lines 250*a* and 250*b* described with reference to FIG. 4.

The first load matching resistors 253*a* and 253*b* may operate as indicated with reference to FIG. 3. Like in FIG. 5, an additional load matching resistor may be installed in the first sub signal lines 261*a* and 261*b* and the second sub signal lines 262*a* and 262*b* in the second signal lines 260*a* and 260*b*.

Figure 12:
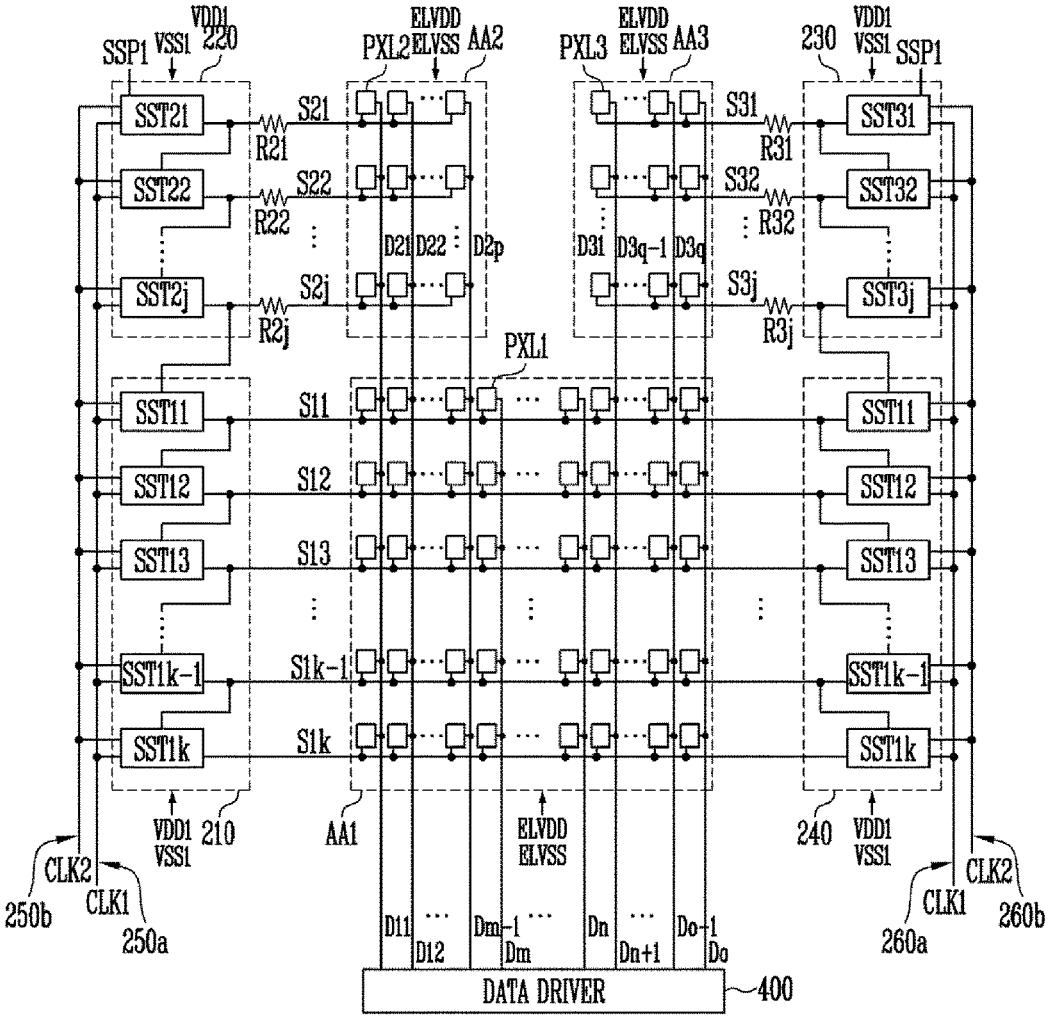
FIG. 12 illustrates another embodiment of load matching resistors.

FIG. 12 illustrates an embodiment of load matching resistors installed at scan lines. In order to match the loads of the first scan lines S11 to S1*k* and the third scan lines S31 to S3*j*, second load matching resistors R31 to R3*j* may be installed in the third scan lines S31 to S3*j*. The second load matching resistors R31 to R3*j* may be connected between the third scan driver 230 and the third scan lines S31 to S3*j*.

The second load matching resistors R31 to R3*j* may have the same resistance value or different resistance values. For example, at least some of the third scan lines S31 to S3*j* may have different loads, so that at least some of the second load matching resistors R31 to R3*j* related to the some of the third scan lines S31 to S3*j* may have different resistance values. In one embodiment, the second load matching resistors R31 to R3*j* may be connected between output terminals of the scan stage circuits SST31 to SST3*j* in the third scan driver 230 and the third scan lines S31 to S3*j*.

The second load matching resistors R31 to R3*j* may be formed of a material having higher resistance than that of the third scan lines S31 to S3*j*. For example, the third scan lines S31 to S3*j* may be formed of the same material as the source and drain electrodes of the transistors in the pixels PXL1, PXL2, and PXL3. The second load matching resistors R31 to R3*j* may be formed of the same material as gate electrode or the semiconductor layer of the transistors in the pixels PXL1, PXL2, and PXL3.

The third scan lines S31 to S3*j* may be formed of the same material as the gate electrodes of the transistors in the pixels PXL1, PXL2, and PXL3.

The second load matching resistors R31 to R3*j* may be formed of the same material as the semiconductor layers of the transistors in the pixels PXL1, PXL2, and PXL3. The first load matching resistors R21 to R2*j* may operate as described with reference to FIG. 6.

Figure 13:
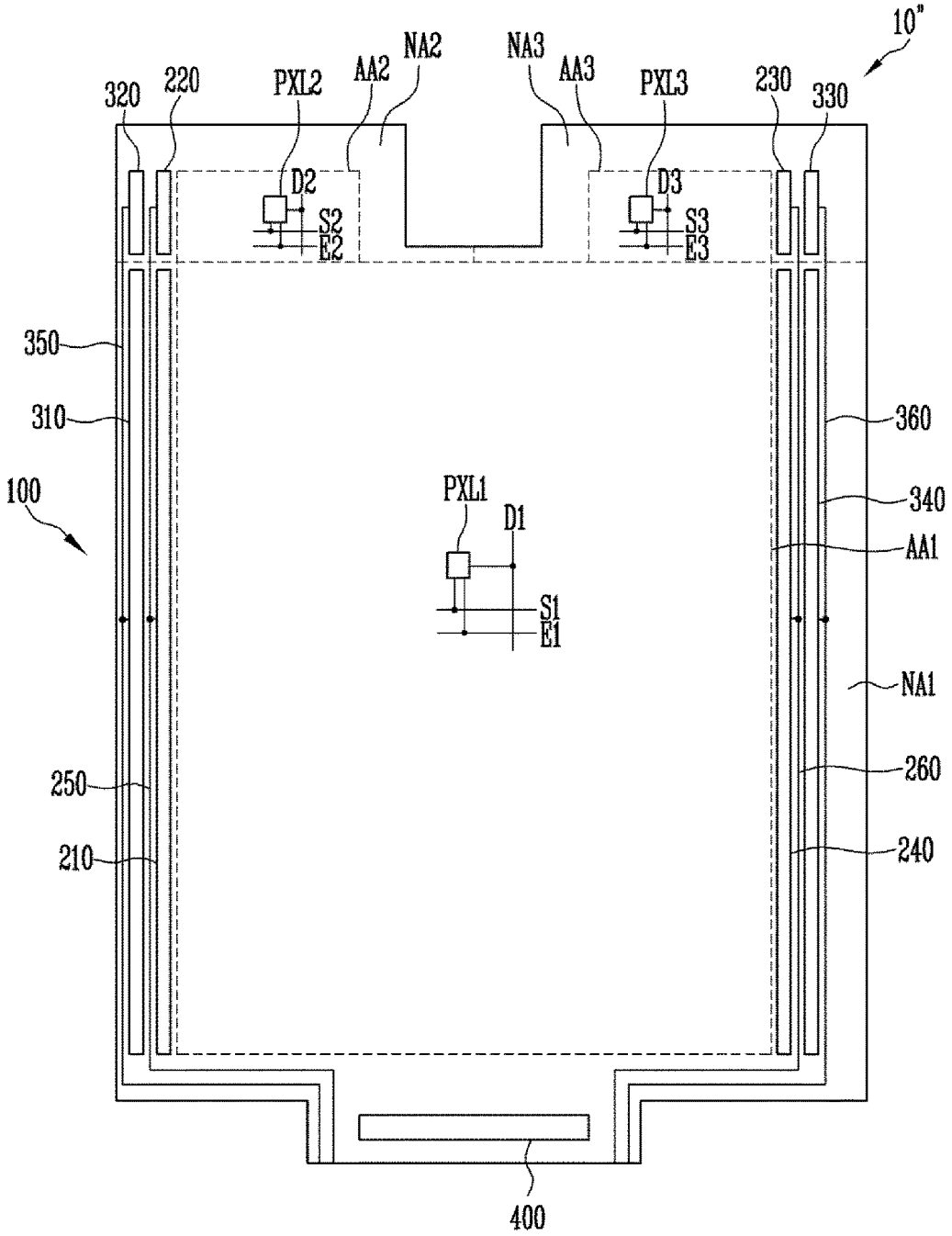
FIG. 13 illustrates another embodiment of a display device.

FIG. 13 illustrates another embodiment of a display device 10" which may include a substrate 100, first pixels PXL1, second pixels PXL2, third pixels PXL3, a first scan driver 210, a second scan driver 220, a third scan driver 230, a fourth scan driver 240, a first emission driver 310, a second emission driver 320, a third emission driver 330, and a fourth emission driver 340.

The first pixels PXL1 may be in a first pixel area AA1, and may be connected with a first scan line S1, a first emission control line E1, and a first data line D1.

The first scan driver 210 and the fourth scan driver 240 may supply a first scan signal to the first pixels PXL1 through the first scan lines S1. The first scan driver 210 and the fourth scan driver 240 may be in a first neighboring area NA1. For example, the first scan driver 210 may be in the first neighboring area NA1 adjacent to one side (for example, a left side) of the first pixel area AA1, and the fourth scan driver 240 may be in a second neighboring area NA2 adjacent to the other side (for example, a right side) of the first pixel area AA1. The first scan driver 210 and the fourth scan driver 240 may drive at least some of the first scan lines S1. In one embodiment, one of the first scan driver 210 or the fourth scan driver 240 may be omitted.

The first emission driver 310 and the fourth emission driver 340 may supply a first emission control signal to the first pixels PXL1 through first emission control lines E1. For example, the first emission driver 310 and the fourth emission driver 340 may sequentially supply the first emission control signal to the first emission control lines E1.

The first emission driver 310 and the fourth emission driver 340 may be in the first neighboring area NA1. For example, the first emission driver 310 may be in the first neighboring area NA1 adjacent to one side (for example, a left side) of the first pixel area AA1. The fourth emission driver 340 may be in the first neighboring area NA1 adjacent to the other side (for example, a right side) of the first pixel area AA1.

The first emission driver 310 and the fourth emission driver 340 may drive at least some of the first emission control lines E1. In one embodiment, one of the first emission driver 310 or the fourth emission driver 340 may be omitted.

FIG. 13 illustrates a case where the first emission driver 310 is at an external side of the first scan driver 210. In another embodiment, the first emission driver 310 may be at an internal side of the first scan driver 210. Further, FIG. 13 illustrates the case where the fourth emission driver 340 is at an external side of the fourth scan driver 240. In one embodiment, the fourth emission driver 340 may be at an internal side of the fourth scan driver 240.

The second pixels PXL2 may be in a second pixel area AA2 and may be connected with a second scan line S2, a second emission control line E2, and a second data line D2. The second scan driver 220 may supply a second scan signal to the second pixels PXL2 through the second scan lines S2. The second scan driver 220 may be in a second neighboring area NA2 adjacent to one side (for example, the left side) of the second pixel area AA2.

The second emission driver 320 may supply a second emission control signal to the second pixels PXL2 through the second emission control lines E2. For example, the second emission driver 320 may sequentially supply the second emission control signal to the second emission control lines E2. The second emission driver 320 may be in the second neighboring area NA2 adjacent to one side (for example, the left side) of the second pixel area AA2.

In one embodiment, both the second scan driver 220 and the second emission driver 320 may be in the second neighboring area NA2 adjacent to one side (for example, the left side based on FIG. 13) of the second pixel area AA2. In this case, the second emission driver 320 may be at an external side of the second scan driver 220 as in FIG. 13. In one embodiment, the second emission driver 320 may also be at an internal side of the second scan driver 220.

The positions of the second scan driver 220 and the second emission driver 320 may be different in other embodiments. For example, both the second scan driver 220 and the second emission driver 320 may also be at the other side (for example, the right side) of the second pixel area AA2.

The second pixel area AA2 has a smaller area than the first pixel area AA1, so that the second scan line S2 and the second emission control line E2 may be shorter than the first scan line S1 and the first emission control line E1. Further, the number of second pixels PXL2 connected to one second emission control line E2 may be less than that of the first pixels PXL1 connected to one first emission control line E1.

The third pixels PXL3 may be in the third pixel area AA3. Each of the third pixels PXL3 may be connected with a third scan line S3 and a third data line D3.

The third scan driver 230 may supply a third scan signal to the third pixels PXL3 through the third scan lines S3. The third scan driver 230 may be in a third neighboring area NA3 adjacent to one side (for example, the right side) of the third pixel area AA3.

The third emission driver 330 may supply a third emission control signal to the third pixels PXL3 through the third emission control lines E3. For example, the third emission driver 330 may sequentially supply the third emission control signal to the third emission control lines E3. The third emission driver 330 may be in the third neighboring area NA3 adjacent to one side (for example, the right side) of the third pixel area AA3.

In one embodiment, both the third scan driver 230 and the third emission driver 330 may be in the third neighboring area NA3 adjacent to one side (for example, the right side based on FIG. 13) of the third pixel area AA3. In this case, the third emission driver 330 may be at an external side of the third scan driver 230 as in FIG. 13. In one embodiment, the third emission driver 330 may also be an internal side of the third scan driver 230.

The positions of the third scan driver 230 and the third emission driver 330 may be different in other embodiments. For example, both the third scan driver 230 and the third emission driver 330 may also be at the other side (for example, the left side) of the third pixel area AA3.

The third pixel area AA3 has a smaller area than the first pixel area AA1, so that the third scan line S3 and the third emission control line E3 may be shorter than the first scan line S1 and the first emission control line E1. Further, the number of third pixels PXL3 connected to one third emission control line E3 may be less than that of the first pixels PXL1 connected to one first emission control line E1.

The emission control signal is used for controlling emission times of the pixels PXL1, PXL2, and PXL3. To this end, the emission control signal may be set to have a larger width than that of the scan signal.

In addition, the emission control signal may be set with a gate-off voltage (for example, a high level voltage) so that transistors in the pixels PXL1, PXL2, and PXL3 may be turned off. The scan signal may have a gate-on voltage (for example, a low level voltage) so that transistors in the pixels PXL1, PXL2, and PXL3 may be turned on.

The first scan driver 210 and the second scan driver 220 may operates based on a first driving signal. To this end, the first signal line 250 may supply the first driving signal to the first scan driver 210 and the second scan driver 220. In this case, the first signal line 250 may be in the neighboring areas NA1 and NA2.

The third scan driver 230 and the fourth scan driver 240 may operated based on to a second driving signal. To this end, the second signal line 260 may supply the second driving signal to the third scan driver 230 and the fourth scan driver 240. In this case, the second signal line 260 may be in the neighboring areas NA1 and NA3.

The first signal line 250 and the second signal line 260 may receive the first driving signal and the second driving signal, respectively, from a separate constituent element (for example, a timing controller). The first signal line 250 and the second signal line 260 may be elongated toward a lower side of the first pixel area AA1.

Further, a plurality of signal lines may be used in place of each of the first signal lines 250 and the second signal lines 260. The first driving signal and the second driving signal may be a clock signal.

The first emission driver 310 and the second emission driver 320 may operate based on a third driving signal. To this end, the third signal line 350 may supply the third driving signal to the first emission driver 310 and the second emission driver 320. In this case, the third signal line 350 may be in the neighboring areas NA1 and NA2.

The third emission driver 330 and the fourth emission driver 340 may operate based on a fourth driving signal. To this end, the fourth signal line 360 may supply the fourth driving signal to the third emission driver 330 and the fourth emission driver 340. In this case, the fourth signal line 360 may be in the neighboring areas NA1 and NA3.

The third signal line 350 and the fourth signal line 360 may receive the third driving signal and the fourth driving signal, respectively, from a separate constituent element (for example, a timing controller). The third signal line 350 and the fourth signal line 360 may be elongated toward the lower side of the first pixel area AA1. Further, the number of the third signal lines 350 and the number of the fourth signal lines 360 may be plural. The first driving signal and the second driving signal may be a clock signal.

Figure 14:
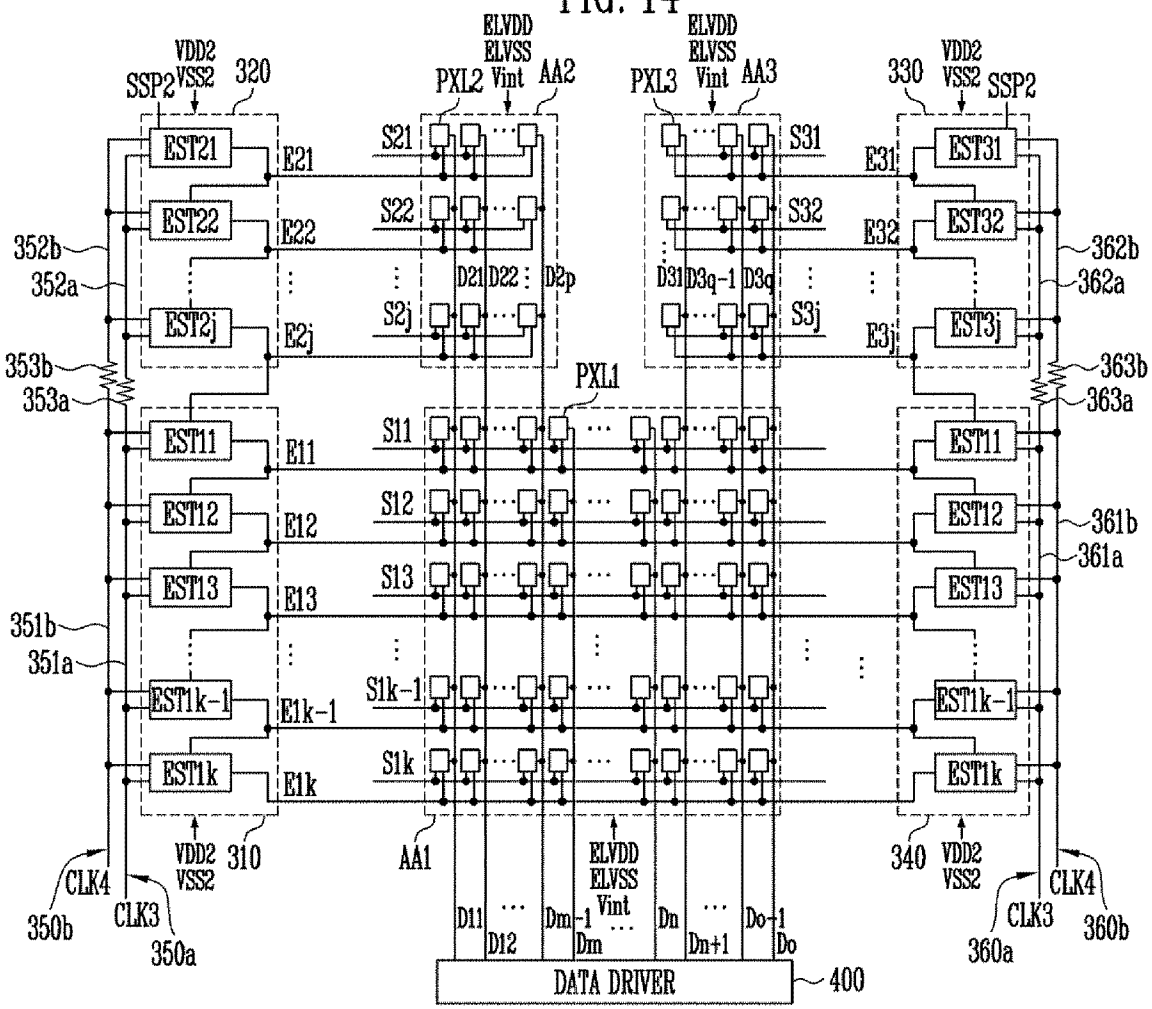
FIG. 14 illustrates another embodiment of a load matching resistor.

FIG. 14 illustrates another embodiment of a load matching resistor installed at a signal line. Referring to FIG. 14, a display device 10, 10', or 10" may include a plurality of third signal lines 350*a* and 350*b* and a plurality of fourth signal lines 360*a* and 360*b* for supplying driving signals CLK3 and CLK4 to emission drivers 310, 320, 330, and 340. The driving signals CLK3 and CLK4 may include a third clock signal CLK3 and a fourth clock signal CLK4. For example, the third clock signal CLK3 and the fourth clock signal CLK4 may have different phases.

The third signal lines 350*a* and 350*b* may supply the clock signals CLK3 and CLK4 to the first emission driver 310 and the second emission driver 320. For example, the first third signal line 350*a* may supply the third clock signal CLK3 to the first emission driver 310 and the second emission driver 320, and the second third signal line 350*b* may supply the fourth clock signal CLK4 to the first emission driver 310 and the second emission driver 320.

The fourth signal lines 360*a* and 360*b* may supply the clock signals CLK3 and CLK4 to the third emission driver 330 and the fourth emission driver 340. For example, the first fourth signal line 360*a* may supply the third clock signal CLK3 to the third emission driver 330 and the fourth emission driver 340, and the second fourth signal line 360*b* may supply the fourth clock signal CLK4 to the third emission driver 330 and the fourth emission driver 340.

The first emission driver 310 may be connected to first ends of the first emission control lines E11 to E1*k*, and the fourth emission driver 340 may be connected to the second ends of the first emission control lines E11 to E1*k*. For example, the first emission control lines E11 to E1*k* may be connected between the first emission driver 310 and the fourth emission driver 340.

In order to prevent delay of emission control signal, the first emission driver 310 and the fourth emission driver 340 may simultaneously supply a first emission control signal to the same emission control line. For example, the first first emission control line E11 may receive the first emission control signal from the first emission driver 310 and the fourth emission driver 340 at the same time. Then, the second first emission control line E12 may receive the first emission control signal from the first emission driver 310 and the fourth emission driver 340 at the same time.

As described above, the first emission driver 310 and the fourth emission driver 340 may sequentially supply the first emission control signal to the first emission control lines E11 to E1*k*.

The first emission driver 310 may include a plurality of emission stage circuits EST11 to EST1*k*. The emission stage circuits EST11 to EST1*k* of the first emission driver 310 may be connected to first ends of the first emission control lines E11 to E1*k*, respectively, and may supply the first emission control signal to the first emission control lines E11 to E1*k*, respectively. The emission stage circuits EST11 to EST1*k* may operate based on the clock signals CLK3 and CLK4 supplied, for example, from an external source. The emission stage circuits EST11 to EST1*k* may be identical circuits.

The emission stage circuits EST11 to EST1*k* may receive output signals (that is, the emission control signals) or start pulses of the previous emission stage circuits. For example, the first emission stage circuit EST11 may receive a start pulse. The remaining emission stage circuits EST12 to EST1*k* may receive the output signals of the previous stages circuits.

As illustrated in FIG. 14, the first emission stage circuit EST11 of the first emission driver 310 may use a signal output from the last emission stage circuit EST2*j* of the second emission driver 320 as a start pulse. In another exemplary embodiment, the first emission stage circuit EST11 of the first emission driver 310 may not receive a signal output from the last emission stage circuit SST2*j* of the second emission driver 320, and may separately receive a start pulse.

Each of the emission stage circuits EST11 to EST1*k* may receive a third driving power source VDD2 and a fourth driving power source VSS2. The third driving power source VDD2 may be a gate-off voltage, for example, a high level voltage. The fourth driving power source VSS2 may be a gate-on voltage, for example, a low level voltage.

Further, the third driving power source VDD2 may have the same voltage as the first driving power source VDD1. The fourth driving power source VSS2 may have the same voltage as the second driving power source VSS1.

The fourth emission driver 340 may include a plurality of emission stage circuits EST11 to EST1*k*. The emission stage circuits EST11 to EST1*k* of the fourth emission driver 340 may be connected to the second ends of the first emission control lines E11 to E1*k*, respectively, and may supply the first emission control signal to the first emission control lines E11 to E1*k*, respectively. The emission stage circuits EST11 to EST1*k* of the fourth emission driver 340 may have the same configuration as the first emission driver 310.

The first pixels PXL1 may receive a first pixel power source ELVDD, a second pixel power source ELVSS, and an initialization power source Vint. The second emission driver 320 may be connected to first ends of the second emission control lines E21 to E2*j*.

The second emission driver 320 may include a plurality of emission stage circuits EST21 to EST2*k*. The emission stage circuits EST21 to EST2*j* of the second emission driver 320 may be connected to first ends of the second emission control lines E21 to E2*k*, respectively, and may supply a second emission control signal to the second emission control lines E21 to E2*j*, respectively.

The emission stage circuits EST21 to EST2*j* may operate based on the clock signals CLK3 and CLK4 supplied, for example, from a external source. The emission stage circuits EST21 to EST2*k* may be identical circuits.

The emission stage circuits EST21 to EST2*k* may receive output signals (that is, the emission control signals) or start pulses of the previous emission stage circuits. For example, the first emission stage circuit EST21 may receive a start pulse SSP2, and the remaining emission stage circuits EST22 to EST2*j* may receive the output signals of the previous stages circuits. The last emission stage circuit EST2*j* of the second emission driver 320 may supply the output signal to the first emission stage circuit EST11 of the second emission driver 320.

Each of the emission stage circuits EST21 to EST2*j* may receive the third driving power source VDD2 and the fourth driving power source VSS2. The third driving power source VDD2 may be a gate-off-voltage, for example, a high level voltage. The fourth driving power source VSS2 may be a gate-on voltage, for example, a low level voltage.

Further, the second pixels PXL2 may receive a first pixel power source ELVDD, a second pixel power source ELVSS, and an initialization power source Vint. The third emission driver 330 may be connected to first ends of the third emission control lines E31 to E3*j*. The third emission driver 330 may include a plurality of emission stage circuits EST31 to EST3*j*. The emission stage circuits EST31 to EST3*j* of the third emission driver 330 may be connected to first ends of the third emission control lines E31 to E3*j*, respectively, and may supply the third emission control signal to the third emission control lines E31 to E3*j*, respectively.

In this case, the emission stage circuits EST31 to EST3*j* may operate based on the clock signals CLK3 and CLK4 supplied from the outside. The emission stage circuits EST31 to EST3*j* may be identical circuits.

The emission stage circuits EST31 to EST3*j* may receive output signals (that is, the emission control signals) or start pulses of the previous emission stage circuits. For example, the first emission stage circuit EST31 may receive a start pulse SSP2. The remaining emission stage circuits EST32 to EST3*j* may receive the output signals of the previous stages circuits. The last emission stage circuit EST3*j* of the third emission driver 330 may supply the output signal to the first emission stage circuit EST11 of the fourth emission driver 340.

Each of the emission stage circuits EST11 to EST3*j* may receive the third driving power source VDD2 and the fourth driving power source VSS2. The third driving power source VDD2 may be a gate-off voltage, for example, a high level voltage. The fourth driving power source VSS2 may be a gate-on voltage, for example, a low level voltage.

The third pixels PXL2 may receive the first pixel power source ELVDD, the second pixel power source ELVSS, and an initialization power source Vint.

The loads of the first emission control lines E11 to E1*k* may be different from the loads of the second emission control lines E21 to E2*j*. The first emission control lines E11 to E1*k* may be longer than the second emission control lines E21 to E2*j*. The number of first pixels PXL1 may be greater larger than the number of the second pixels PXL2, so that the loads of the first emission control lines E11 to E1*k* may be greater than the loads of the second emission control lines E21 to E2*j*.

Capacitance of the first emission control lines E11 to E1*k* may be larger than that of the second emission control lines E21 to E2*j*. This causes a difference in a time constant between the first emission control signal and the second emission control signal. The difference may cause a brightness difference between the first pixels PXL1 and the second pixels PXL2.

According to the present exemplary embodiment, the load matching resistors 353*a* and 353*b* may be installed in the third signal lines 350*a* and 350*b*. Accordingly, it is possible to match the loads of the first emission control lines E11 to E1*k* and the second emission control lines E21 to E2*j*, and brightness of the first pixel area AA1 and the second pixel area AA2 may be uniform.

The first third signal line 350*a* may include, for example, a first sub signal line 351*a*, a second sub signal line 352*a*, and a third load matching resistor 353*a*. The first sub signal line 351*a* may be connected with the first emission driver 310, and may supply the third clock signal CLK3 to the first emission driver 310. The second sub signal line 352*a* may be connected with the second emission driver 320, and may supply the fourth clock signal CLK4 to the second emission driver 340. The third load matching resistor 353*a* may be connected between the first sub signal line 351*a* and the second sub signal line 352*a*.

One end of the first sub signal line 351*a* may receive the third clock signal CLK3. The other end of the first sub signal line 351*a* may be connected to the third load matching resistor 353*a*. Accordingly, the first sub signal line 351*a* may receive the third clock signal CLK3 and may transmit the third clock signal CLK3 to the second sub signal line 352*a* through the third load matching resistor 353*a*.

The second third signal line 350*b* may include a first sub signal line 351*b*, a second sub signal line 352*b*, and a third load matching resistor 353*b*, identically to the first third signal line 350*a*. The first sub signal line 351*b* may be connected with the first emission driver 310, and may supply the fourth clock signal CLK4 to the first emission driver 310. The second sub signal line 352*b* may be connected with the second emission driver 320, and may supply the fourth clock signal CLK4 to the second emission driver 320. The third load matching resistor 353*b* may be connected between the first sub signal line 351*b* and the second sub signal line 352*b*.

One end of the first sub signal line 351*b* may receive the fourth clock signal CLK4. The other end of the first sub signal line 351*b* may be connected to the third load matching resistor 353*b*. Accordingly, the first sub signal line 351*b* may receive the fourth clock signal CLK4, and may transmit the fourth clock signal CLK4 to the second sub signal line 352*b* through the third load matching resistor 353*b*.

The third load matching resistors 353*a* and 353*b* may be connected between the first emission stage circuit EST11 of the first emission driver 310 and the last emission stage circuit EST2*j* of the second emission driver 320.

Loads of the first emission control lines E11 to E1*k* may be different from the loads of the third emission control lines E31 to E3*j*. For example, the first emission control lines E11 to E1*k* may be longer than the third emission control lines E31 to E3*j*. The number of first pixels PXL1 may be greater than the number of third pixels PXL3. As a result, the loads of the first emission control lines E11 to E1*k* may be greater than the loads of the third emission control lines E31 to E3*j*.

Like the third signal lines 350*a* and 350*b*, load matching resistors 363*a* and 363*b* may be installed in the fourth signal lines 360*a* and 360*b*. Accordingly, it is possible to match the loads of the first emission control lines E11 to E1*k* and the third emission control lines E31 to E3*j*, and brightness of the first pixel area AA1 and the third pixel area AA3 may be uniform.

The first fourth signal line 360*a* may include, for example, a first sub signal line 361*a*, a second sub signal line 362*a*, and a fourth load matching resistor 363*a*. The first sub signal line 361*a* may be connected with the fourth emission driver 340, and may supply the third clock signal CLK3 to the fourth emission driver 340. The second sub signal line 362*a* may be connected with the third emission driver 330, and may supply the fourth clock signal CLK4 to the third emission driver 330. The fourth load matching resistor 363*a* may be connected between the first sub signal line 361*a* and the second sub signal line 362*a*.

One end of the first sub signal line 361*a* may receive the third clock signal CLK3. The other end of the first sub signal line 361*a* may be connected to the fourth load matching resistor 363*a*. Accordingly, the first sub signal line 361*a* may receive the third clock signal CLK3, and may transmit the third clock signal CLK3 to the second sub signal line 362*a* through the fourth load matching resistor 363*a*.

The second fourth signal line 360*b* may include a first sub signal line 361*b*, a second sub signal line 362*b*, and a fourth load matching resistor 363*b*, identically to the first fourth signal line 360*a*. The first sub signal line 361*b* may be connected with the fourth emission driver 340, and may supply the fourth clock signal CLK4 to the fourth emission driver 340. The second sub signal line 362*b* may be connected with the third emission driver 330, and may supply the fourth clock signal CLK4 to the third emission driver 330. The fourth load matching resistor 363*b* may be connected between the first sub signal line 361*b* and the second sub signal line 362*b*.

One end of the first sub signal line 361*b* may receive the fourth clock signal CLK4. The other end of the first sub signal line 361*b* may be connected to the fourth load matching resistor 363*b*. Accordingly, the first sub signal line 361*b* may receive the fourth clock signal CLK4, and may transmit the fourth clock signal CLK4 to the second sub signal line 362*b* through the fourth load matching resistor 363*b*.

The fourth load matching resistors 363*a* and 363*b* may be connected between the first emission stage circuit EST11 of the fourth emission driver 340 and the last emission stage circuit EST3*j* of the third emission driver 330. The third signal lines 350*a* and 350*b* and the fourth signal lines 360*a* and 360*b* may have the same material and structure as the first signal lines 250*a* and 250*b* described with reference to FIG. 4.

Figure 15:
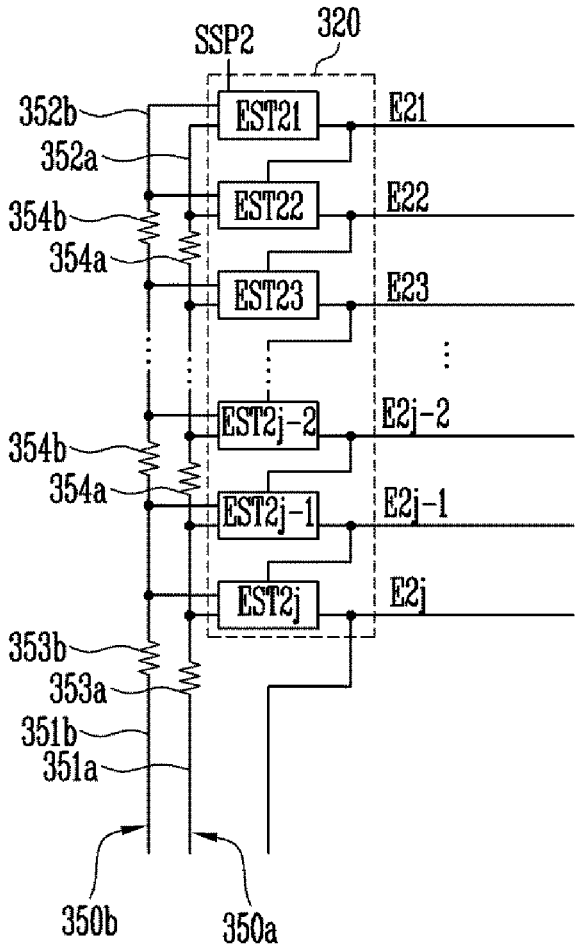
FIG. 15 illustrates an embodiment of a signal line and a emission driver.

FIG. 15 illustrates an embodiment of the third signal line and the second emission driver. Referring to FIG. 15, one or more additional load matching resistors 354*a* and 354*b* may be installed in the second sub signal lines 352*a* and 352*b* in the third signal lines 350*a* and 350*b*.

The loads of the second emission control lines E21 to E2*j* may be different from each other. For example, the lengths of the second emission control lines E21 to E2*j* may be different from each other according to the form of the second pixel area AA2. Further, the number of pixels PXL2 connected to each of the second emission control lines E21 to E2*j* may also be different.

In this case, the load matching resistors 354*a* and 354*b* may be additionally used to match the loads of the second emission control lines E21 to E2*j*. Each of the second sub signal lines 352*a* and 352*b* may be separated into a plurality of signal lines. The load matching resistors 354*a* and 354*b* may be connected between the separated signal lines.

Finally, the load matching resistors 354*a* and 354*b* may be connected between the adjacent two stage circuits (for example, the stage circuits EST22 and EST23, and the stage circuits EST2*j*−2 and EST2*j*−1). The load matching resistors 354*a* and 354*b* may have the same material and structure as the first load matching resistor 353*a* described with reference to FIG. 4.

The second sub signal lines 352*a* and 352*b* in the third signal lines 350*a* and 350*b* have been described, but the load matching resistors may be additionally installed in the first sub signal lines 351*a* and 351*b* in the third signal lines 350*a* and 350*b*, and the first sub signal lines 361*a* and 361*b* and the second sub signal lines 362*a* and 362*b* in the fourth signal lines 360*a* and 360*b*.

Figure 16:
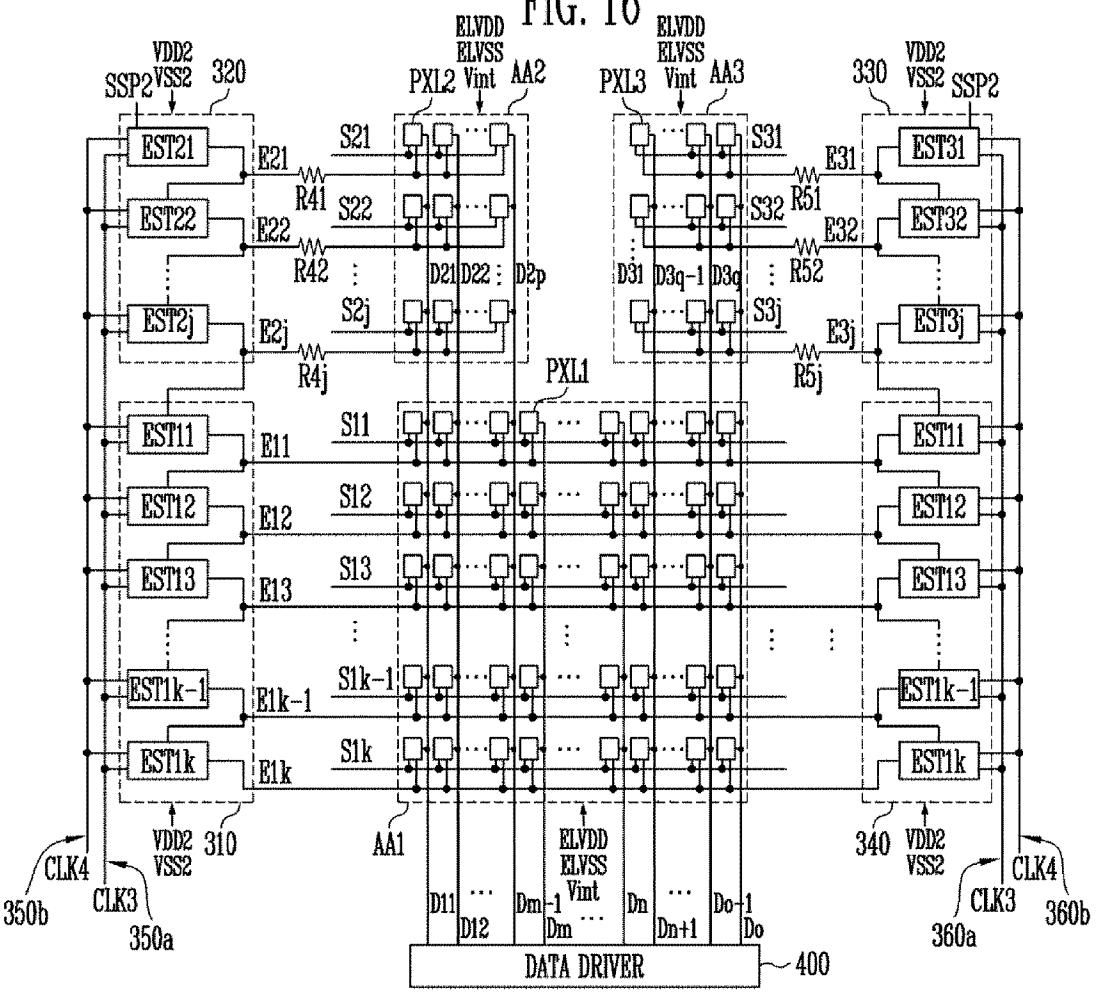
FIG. 16 illustrates another embodiment of a load matching resistor.

FIG. 16 illustrates an embodiment of a load matching resistor installed at a light emitting control line. In order to match the loads of the first emission control lines E11 to E1*k* and the second emission control lines E21 to E2*j*, third load matching resistors R41 to R4*j* may be in the second emission control lines E21 to E2*j*. The third load matching resistors R41 to R4*j* may be connected between the second emission driver 320 and the second emission control lines E21 to E2*j*.

The third load matching resistors R41 to R4*j* may have the same resistance value or different resistance values. For example, at least some of the second emission control lines E21 to E2*j* may have different loads, so that at least some of the third load matching resistors R41 to R4*j* related to the some of the second emission control lines E21 to E2*j* may have different resistance values.

In one embodiment, the third load matching resistors R41 to R4*j* may be connected between output terminals of the emission stage circuits EST21 to EST2*j* in the second emission driver 320 and the second emission control lines E21 to E2*j*. The third load matching resistors R41 to R4*j* may be formed of a material having higher resistance than that of the second emission control lines E21 to E2*j*.

The second emission control lines E21 to E2*j* may be formed, for example, of the same material as the source and drain electrodes of the transistors in the pixels PXL1, PXL2, and PXL3. The third load matching resistors R41 to R4*j* may be formed of the same material as the gate electrode or the semiconductor layer of the transistors in the pixels PXL1, PXL2, and PXL3.

The second emission control lines E21 to E2*j* may be formed of the same material as the gate electrodes of the transistors in the pixels PXL1, PXL2, and PXL3. The third load matching resistors R41 to R4*j* may be formed of the same material as the semiconductor layers of the transistors in the pixels PXL1, PXL2, and PXL3.

In order to match the loads of the first emission control lines E11 to E1*k* and the third emission control lines E31 to E3*j*, fourth load matching resistors R51 to R5*j* may be installed in the third emission control lines E31 to E3*j*. The fourth load matching resistors R51 to R5*j* may be connected between the third emission driver 330 and the third emission control lines E31 to E3*j*.

The fourth load matching resistors R51 to R5*j* may have the same resistance value or different resistance values. For example, at least some of the third emission control lines E31 to E3*j* may have different loads, so that at least some of the fourth load matching resistors R51 to R5*j* related to the some of the third emission control lines E31 to E3*j* may have different resistance values.

In one embodiment, the fourth load matching resistors R51 to R5*j* may be connected between output terminals of the emission stage circuits EST31 to EST3*j* included in the third emission driver 330 and the third emission control lines E31 to E3*j*. The fourth load matching resistors R51 to R5*j* may be formed of a material having higher resistance than that of the third emission control lines E31 to E3*j*. For example, the third emission control lines E31 to E3*j* may be formed of the same material as the source and drain electrodes of the transistors in the pixels PXL1, PXL2, and PXL3. The fourth load matching resistors R51 to R5*j* may be formed of the same material as the gate electrode or the semiconductor layer of the transistors in the pixels PXL1, PXL2, and PXL3.

The third emission control lines E31 to E3*j* may be formed of the same material as the gate electrodes of the transistors in the pixels PXL1, PXL2, and PXL3. The fourth load matching resistors R51 to R5*j* may be formed of the same material as the semiconductor layers of the transistors in the pixels PXL1, PXL2, and PXL3.

Figure 17:
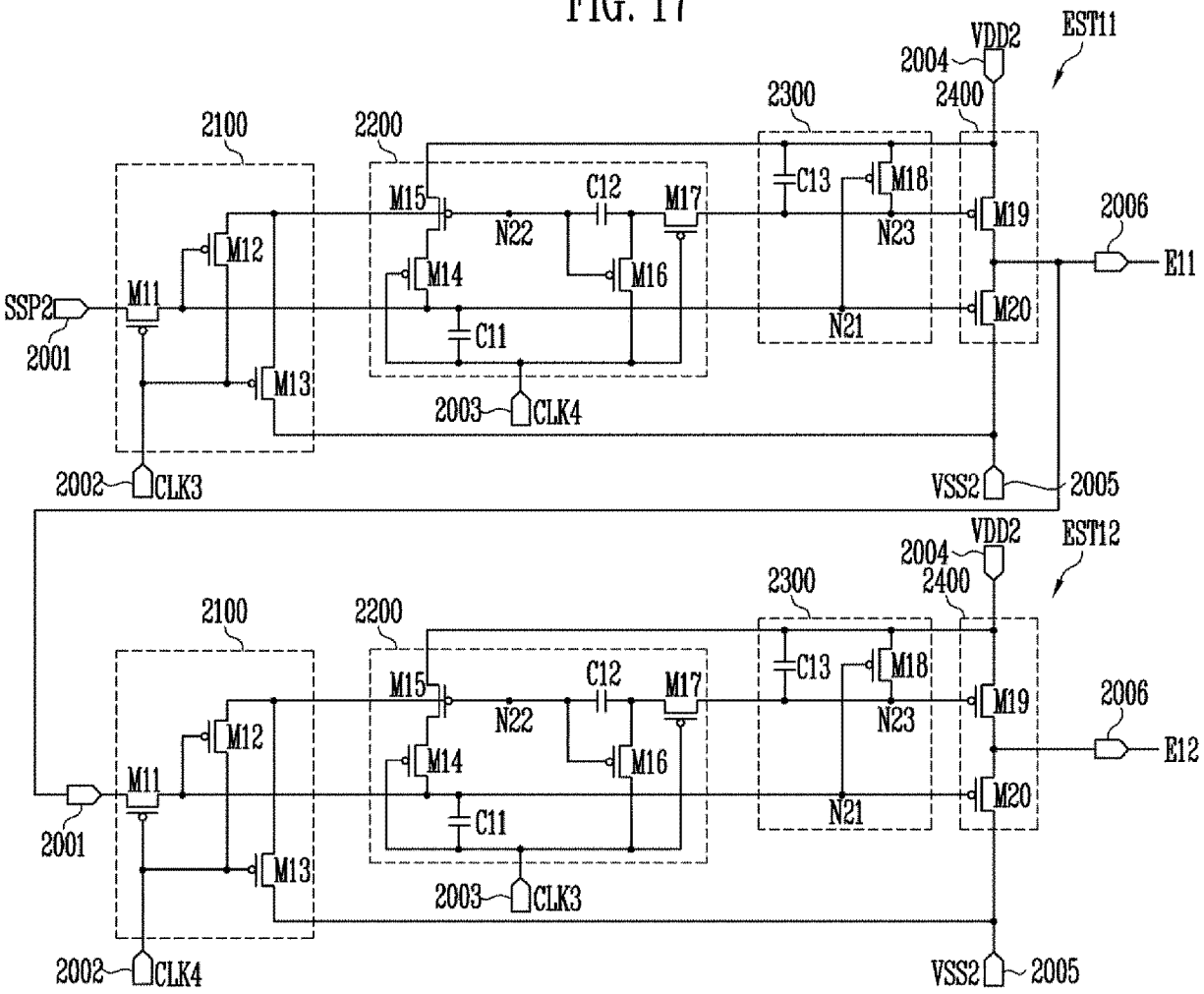
FIG. 17 illustrates an embodiment of a emission stage circuit.

FIG. 17 illustrates an embodiment of a emission stage circuit, for example, corresponding to FIG. 14. For convenience of the description, FIG. 17 illustrates the emission stage circuits EST11 and EST12 of the first emission driver 310.

Referring to FIG. 17, the first emission stage circuit EST11 may include a first driving circuit 2100, a second driving circuit 2200, a third driving circuit 2300, and an output unit 2400. The first driving circuit 2100 may control voltages of a twenty-second node N22 and a twenty-first node N21 based on signals supplied to a first input terminal 2001 to a second input terminal 2002. To this end, the first driving circuit 2100 may include an eleventh transistor M11 to a thirteenth transistor M13.

The eleventh transistor M11 may be connected between the first input terminal 2001 and the twenty-first node N21, and a gate electrode thereof may be connected to the second input terminal 2002. The eleventh transistor M11 may be turned on when the third clock signal CLK3 is supplied to the second input terminal 2002.

The twelfth transistor M12 may be connected between the second input terminal 2002 and the twenty-second node N22, and a gate electrode thereof may be connected to the twenty-first node N21. The twelfth transistor M12 is turned on or turned off based on the voltage of the twenty-first node N21.

The thirteenth transistor M13 may be positioned between a fifth input terminal 2005, which receives the fourth driving power source VSS2, and the twenty-second node N22, and a gate electrode thereof may be connected to the second input terminal 2002. The thirteenth transistor M13 may be turned on when the third clock signal CLK3 is supplied to the second input terminal 2002.

The second driving circuit 2200 may control voltages of the twenty-first node N21 and a twenty-third node N23 based on a signal supplied to a third input terminal 2003 and a voltage of the twenty-second node N22. This end, the second driving circuit 2200 may include a fourteenth transistor M14 to a seventeenth transistor M17, an eleventh capacitor C11, and a twelfth capacitor C12.

The fourteenth transistor M14 may be connected between the fifteenth transistor M15 and the twenty-first node N21, and a gate electrode thereof may be connected to the third input terminal 2003. The fourteenth transistor M14 may be turned on when the fourth clock signal CLK4 is supplied to the third input terminal 2003.

The fifteenth transistor M15 may be connected between a fourth input terminal 2004, which receives the third first driving power source VDD2, and the fourteenth transistor M14, and a gate electrode thereof may be connected to the twenty-second node N22. The fifteenth transistor M15 is turned on or turned off based on the voltage of the twenty-second node N22.

The sixteenth transistor M16 may be connected between a first electrode of the seventeenth transistor M17 and the third input terminal 2003, and a gate electrode thereof may be connected to the twenty-second node N22. The sixteenth transistor M16 is turned on or turned off based on the voltage of the twenty-second node N22.

The seventeenth transistor M17 may be connected between a first electrode of the sixteenth transistor M16 and the twenty-third node N23, and a gate electrode thereof may be connected to the third input terminal 2003. The seventeenth transistor M17 may be turned on when the fourth clock signal CLK4 is supplied to third input terminal 2003.

The eleventh capacitor C11 may be connected between the twenty-first node N21 and the third input terminal 2003.

The twelfth capacitor C12 may be connected between the twenty-second node N22 and the electrode of the seventeenth transistor M17.

The third driving circuit 2300 may control a voltage of the twenty-third node N23 based on a voltage of the twenty-first node N21. The third driving circuit 2300 may include an eighteenth transistor M18 to a thirteenth capacitor C13.

The eighteenth transistor M18 may be connected between the fourth input terminal 2004, which receives the third first driving power source VDD2, and the twenty-third node N23, and a gate electrode thereof may be connected to the twenty-first node N21. The eighteenth transistor M18 may be turned on or turned off based on the voltage of the twenty-first node N21.

The thirteenth capacitor C13 may be connected between the fourth input terminal 2004, which receives the third first driving power source VDD2, and the twenty-third node N23.

The output unit 2400 may control a voltage supplied to an output terminal 2006 based on the voltages of the twenty-first node N21 and the twenty-third node N23. To this end, the output unit 2400 may include a nineteenth transistor M19 and a twentieth transistor M20.

The nineteenth transistor M19 may be connected between the fourth input terminal 2004, which receives the third driving power source VDD2, and the output terminal 2006, and a gate electrode thereof may be connected to the twenty-third node N23. The nineteenth transistor M19 may be turned on or turned off based on the voltage of the twenty-third node N23.

The twentieth transistor M20 may be positioned between the output terminal 2006 and the fifth input terminal 2005, which receives the fourth driving power source VSS2, and a gate electrode thereof may be connected to the twenty-first node N21. The twentieth transistor M20 may be turned on or turned off based on the voltage of the twenty-first node N21. The output unit 2400 may be driven as a buffer.

Additionally, the nineteenth transistor M19 and/or the twentieth transistor M20 may be formed of a plurality of transistors which are connected to each other in parallel.

The second emission stage circuit EST12 and the remaining emission stage circuits EST13 to EST1*k* may have the same configuration as that of the first emission stage circuit EST11.

The second input terminal 2002 of the $j^{th}$ emission stage circuit EST1*j* may receive the third clock signal CLK3, and the third input terminal 2003 thereof may receive the fourth clock signal CLK4. The second input terminal 2002 of the $j+1^{th}$ scan stage circuit EST1*j*+1 may receive the fourth clock signal CLK4, and the third input terminal 2003 thereof may receive the third clock signal CLK3.

The third clock signal CLK3 and the fourth clock signal CLK4 have the same cycle, and phases thereof do not overlap each other. For example, each of the clock signals CLK3 and CLK4 have a cycle of 2H and may be supplied during a different horizontal period.

The stage circuit in the first emission driver 310 may be as in FIG. 17. The stage circuits in other emission drivers (for example, the second emission driver 320, the third emission driver 330, and the fourth emission driver 340), other than the first emission driver 310, may have the same configuration.

Figure 18:
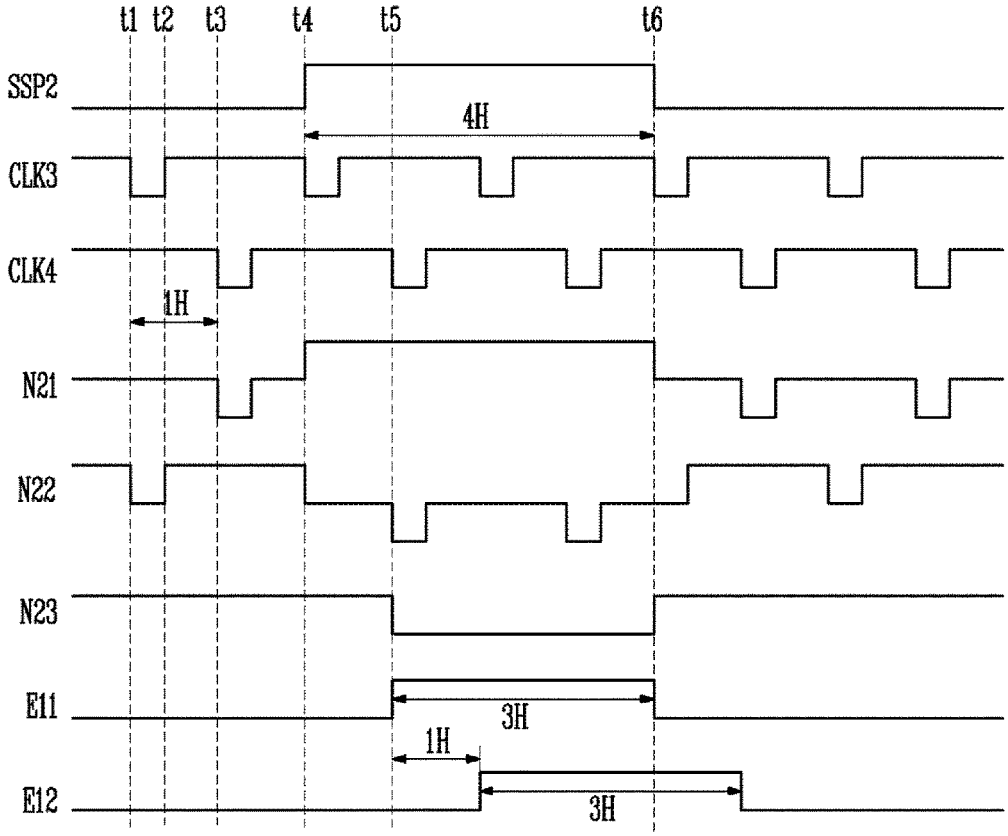
FIG. 18 illustrates an embodiment of a method for driving an emission stage circuit.

FIG. 18 is a waveform diagram illustrating an embodiment of a method for driving the emission stage circuit in FIG. 17. For convenience of the description, in FIG. 18, operation will be described by using the first emission stage circuit EST11.

Referring to FIG. 18, the third clock signal CLK3 and the fourth clock signal CLK4 may have a cycle of 2 horizontal periods (4H), and may be supplied during different horizontal periods. For example, the fourth clock signal CLK4 may be a signal shifted by a half cycle (that is, a 1 horizontal period (1H)) from the third clock signal CLK3.

When the second start pulse SSP2 is supplied, the first input terminal 2001 may be set with the voltage of the third driving power source VDD2. When the second start pulse SSP2 is not supplied, the first input terminal 2001 may have the voltage of the fourth driving power source VSS2. Further, when the clock signal CLK is supplied to the second input terminal 2002 and the third input terminal 2003, the second input terminal 2002 and the third input terminal 2003 may have the voltage of the fourth driving power source VSS2. When the clock signal is not supplied to the second input terminal 2002 and the third input terminal 2003, the second input terminal 1002 and the third input terminal 1003 may have the voltage of the third driving power source VDD2.

The second start pulse SSP2 supplied to the first input terminal 2001 is supplied to be synchronized with the clock signal, that is, the third clock signal CLK3, supplied to the second input terminal 2002. Further, the second start pulse SSP2 may be set to have a larger width than the third clock signal CLK3. For example, the second start pulse SSP2 may be supplied during 4 horizontal periods (4H).

In operation, first, the third clock signal CLK3 may be supplied to the second input terminal at a first time t1. When the third clock signal CLK3 is supplied to the second input terminal 2002, the eleventh transistor M11 and the thirteenth transistor M13 may be turned on.

When the eleventh transistor M11 is turned on, the first input terminal 2001 and the twenty-first node N21 may be electrically connected. Since the second start pulse SSP2 is not supplied to the first input terminal 2001, a voltage with a low level may be supplied to the twenty-first node N21.

When the voltage with the low level is supplied to the twenty-first node N21, the twelfth transistor M12, the eighteenth transistor M18, and the twentieth transistor M20 may be turned on.

When the eighteenth transistor M18 is turned on, the third driving power source VDD2 is supplied to the twenty-third node N23. Thus, the nineteenth transistor M19 may be turned off. In this case, the thirteenth capacitor C13 charges a voltage corresponding to the third driving power source VDD2/. Thus, the nineteenth transistor M19 may stably maintain the turn-off state even after the first time t1.

When the twentieth transistor M20 is turned on, the voltage of the fourth driving power source VSS2 may be supplied to the output terminal 2006. Accordingly, the emission control signal is not supplied to the first first emission control line E11 at the first time t1.

When the twelfth transistor M12 is turned on, the third clock signal CLK3 may be supplied to the twenty-second node N22. Further, when the thirteenth transistor M13 is turned on, the voltage of the fourth driving power source VSS2 may be supplied to the twenty-second node N22. The third clock signal CLK3 may be the voltage of the fourth driving power source VSS2. Thus, the twenty-second node N22 may be stably set with the voltage of the fourth driving power source VSS2. In the meantime, when the voltage of the twenty-second node N22 is set with the voltage of the fourth driving power source VSS2, the seventeenth transistor M17 may be set with a turn-off state. Accordingly, regardless of the voltage of the twenty-second node N22, the twenty-third node N23 may maintain the voltage of the third driving power source VDD2.

The supply of the third clock signal CLK3 to the second input terminal 2002 may be stopped at a second time t2. When the supply of the third clock signal CLK3 is stopped, the eleventh transistor M11 and the thirteenth transistor M13 may be turned off. The voltage of the twenty-first node N21 is maintained at the voltage at the low level by the eleventh capacitor C11. Thus, the twelfth transistor M12, the eighteenth transistor M18 and the twentieth transistor M20 may maintain the turn-on state.

When the twelfth transistor M12 is turned on, the second input terminal 2002 and the twenty-second node N22 may be electrically connected. In this case, the twenty-second node N22 may be a voltage at a high level.

When the eighteenth transistor M18 is turned on, the voltage of the third driving power source VDD2 is supplied to the twenty-third node N23. Thus, the nineteenth transistor M19 may maintain the turn-off state.

When the twentieth transistor M20 is turned on, the voltage of the fourth driving power source VSS2 may be supplied to the output terminal 2006.

The fourth clock signal CLK4 may be supplied to the third input terminal 2003 at a third time t3. When the fourth clock signal CLK4 is supplied to the third input terminal 2003, the fourteenth transistor M14 and the seventeenth transistor M17 may be turned on.

When the seventeenth transistor M17 is turned on, the twelfth capacitor C12 and the twenty-third node N23 are electrically connected. In this case, the twenty-third node N23 may maintain the voltage of the third driving power source VDD2. Then, when the fourteenth transistor M14 is turned on, the fifteenth transistor M15 is set with the turn-off state, so that even though the fourteenth transistor M14 is turned on, the voltage of the twenty-first node N21 is not changed.

When the fourth clock signal CLK4 is supplied to the third input terminal 2003, the voltage of the twenty-first node N21 may be dropped to a voltage lower than that of the fourth driving power source VSS2 by coupling of the eleventh capacitor C11. When the voltage of the twenty-first node N21 is dropped to the voltage lower than that of the fourth driving power source VSS2, the driving characteristics of the eighteenth transistor M18 and the twentieth transistor M20 may be improved (as the PMOS transistor receives a low voltage level, the PMOS transistor has a good driving characteristic).

At a fourth time t4, the second start pulse SSP2 may be supplied to the first input terminal 2001, and the third clock signal CLK3 may be supplied to the second input terminal 2002. When the third clock signal CLK3 is supplied to the second input terminal 2002, the eleventh transistor M11 and the thirteenth transistor M13 may be turned on. When the eleventh transistor M11 is turned on, the first input terminal 2001 and the twenty-first node N21 may be electrically connected. In this case, since the second start pulse SSP2 is not supplied to the first input terminal 2001, a voltage with a high level may be supplied to the twenty-first node N21. When the voltage with the high level is supplied to the twenty-first node N21, the twelfth transistor M12, the eighteenth transistor M18, and the twentieth transistor M20 may be turned off.

When the thirteenth transistor M13 is turned on, the voltage of the fourth driving power source VSS2 may be supplied to the twenty-second node N22. In this case, since the fourteenth transistor M14 is set with the turn-off state, the twenty-first node N21 may maintain the voltage with the high level. Further, since the seventeenth transistor M17 is set with the turn-off state, the voltage of the twenty-third node N23 may maintain the voltage with the high level by the thirteenth capacitor C13. Accordingly, the nineteenth transistor M19 may maintain the turn-off state.

The fourth clock signal CLK4 may be supplied to the third input terminal 2003 at a fourth time t5. When the fourth clock signal CLK4 is supplied to the third input terminal 2003, the fourteenth transistor M14 and the seventeenth transistor M17 may be turned on. Further, since the twenty-second node N22 is set with the voltage of the fourth driving power source VSS2, the fifteenth transistor M15 and the sixteenth transistor M16 may be turned on.

When the sixteenth transistor M16 and the seventh transistor M7 are turned on, the fourth clock signal CLK4 may be supplied to the twenty-third node N23. When the fourth clock signal CLK4 is supplied to the twenty-third node N23, the nineteenth transistor M19 may be turned on. When the nineteenth transistor M19 is turned on, the voltage of the third driving power source VDD2 may be supplied to the output terminal 2006. The voltage of the third driving power source VDD2 supplied to the output terminal 2006 may be supplied to the first first emission control line E11 as the emission control signal.

In the meantime, when the voltage of the fourth clock signal CLK4 is supplied to the twenty-third node N23, the voltage of the twenty-second node N22 is dropped to the voltage lower than that of the fourth driving power source VSS2 by coupling of the twelfth capacitor C12. Thus, the driving characteristics of the transistors connected to the twenty-second node N22 may be improved.

When the fourteenth transistor M14 and the fifteenth transistor M15 are turned on, the voltage of the third driving power source VDD2 may be supplied to the twenty-first node N21. When the voltage of the third driving power source VDD2 is supplied to the twenty-first node N21, the twentieth transistor M20 may maintain the turn-off state. Accordingly, the voltage of the third driving power source VDD2 may be stably supplied to the first first emission control line E11.

The third clock signal CLK3 may be supplied to the second input terminal 2002 at a sixth time t6. When the third clock signal CLK3 is supplied to the second input terminal 2002, the eleventh transistor M11 and the thirteenth transistor M13 may be turned on.

When the eleventh transistor M11 is turned on, the twenty-first node N21 and the first input terminal 2001 are electrically connected, and thus, the twenty-first node N21 may be a voltage at a low level. When the twenty-first node N21 is the voltage at the low level, the eighteenth transistor M18 and the twentieth transistor M20 may be turned on.

When the eighteenth transistor M18 is turned on, the voltage of the third driving power source VDD2 is supplied to the twenty-third node N23, and thus, the nineteenth transistor M19 may be turned off. When the twentieth transistor M20 is turned on, the voltage of the fourth driving power source VSS2 may be supplied to the output terminal 2006. The voltage of the fourth driving power source VSS2 supplied to the output terminal 2006 may be supplied to the first first emission control line E11. Thus, the supply of the emission control signal may be stopped.

The emission stage circuits EST of the present embodiment may sequentially output the emission control signal to the emission control lines while repeating the aforementioned process.

Figure 19:
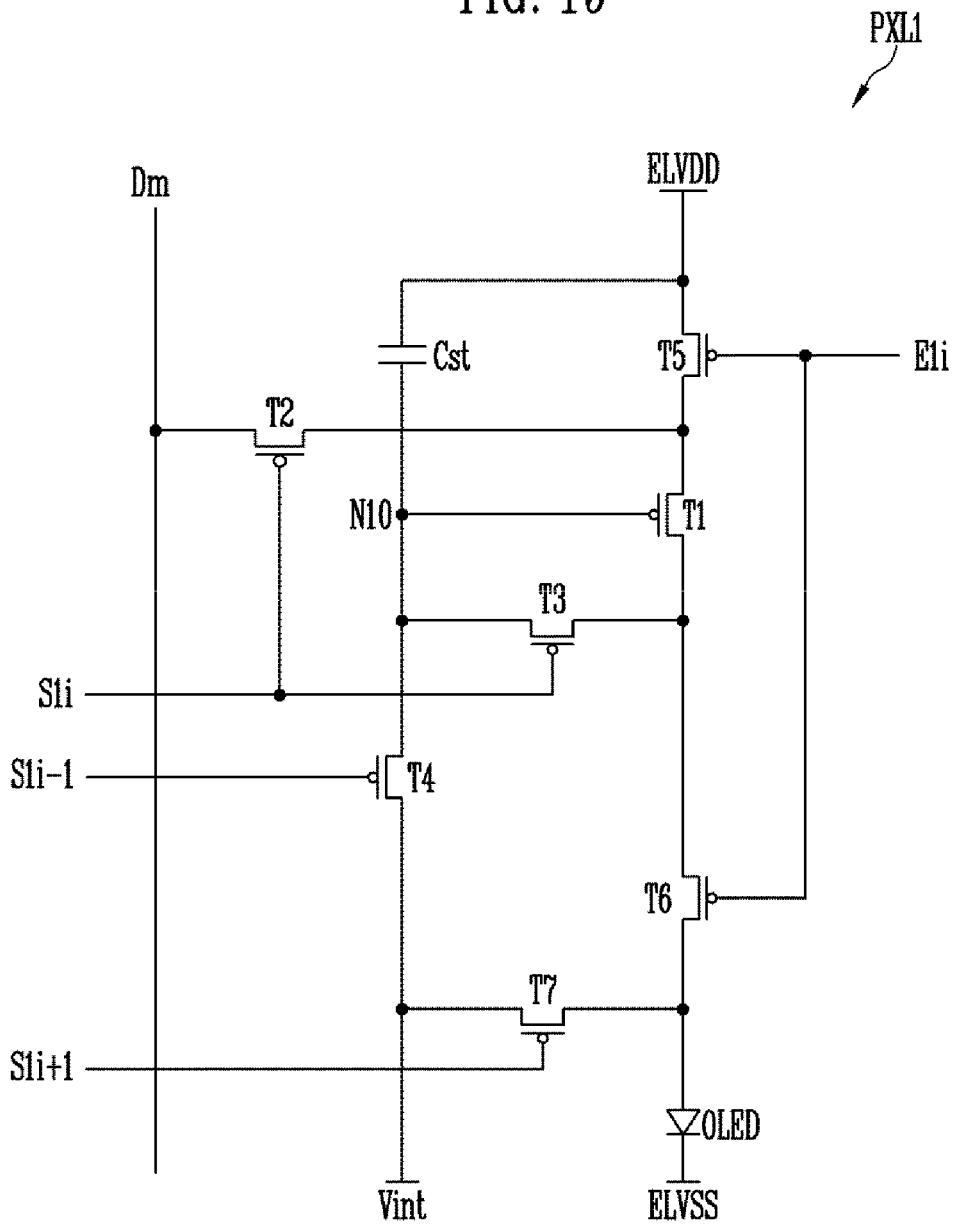
FIG. 19 illustrates another embodiment of a pixel.

FIG. 19 illustrates an embodiment of the first pixel in FIG. 13. For convenience of the description, FIG. 19 illustrates the first pixel PXL1 connected to the $m^{th}$ data line Dm and the $i^{th}$ first scan line S1$i$.

Referring to FIG. 19, the first pixel PXL1 may include an organic light emitting diode OLED, a first transistor T1 to a seventh transistor T7, and a storage capacitor Cst. An anode of the organic light emitting diode OLED may be connected to the first transistor T1 via the sixth transistor T6, and a cathode thereof may be connected to a second pixel power source ELVSS. The organic light emitting diode OLED may generate light with predetermined brightness based on a current supplied from the first transistor T1.

A first pixel power source ELVDD may be a higher voltage than the second pixel power source ELVSS, so that a current may flow to the organic light emitting diode OLED.

The seventh transistor T7 may be connected between an initialization power source Vint and the anode of the organic light emitting diode OLED. Further, a gate electrode of the seventh transistor T7 may be connected to an $i+1^{th}$ first scan line S1$i$+1. The seventh transistor T7 may be turned on when a scan signal is supplied to the $i+1^{th}$ first scan line S1$i$+1 to supply the voltage of the initialization power source Vint to the anode of the organic light emitting diode OLED. Here, the initialization power source Vint may be a lower voltage than that of the data signal.

The sixth transistor T6 may be connected between the first transistor T1 and the organic light emitting diode OLED. Further, a gate electrode of the sixth transistor T6 may be connected to an $i^{th}$ first emission control line E1$i$. The sixth transistor T6 may be turned off when a emission control signal is supplied to the $i^{th}$ first emission control line E1$i$, and may be turned off in other cases.

The fifth transistor T5 may be connected between the first pixel power source ELVDD and the first transistor T1. Further, a gate electrode of the fifth transistor T5 may be connected to the $i^{th}$ first emission control line E1$i$. The fifth transistor T5 may be turned off when a emission control signal is supplied to the $i^{th}$ first emission control line E1*i*, and may be turned off in other cases.

A first electrode of the first transistor T1 (the driving transistor) may be connected to the first pixel power source ELVDD via the fifth transistor T5, and a second electrode thereof may be connected to the anode of the organic light emitting diode OLED via the sixth transistor T6. Further, a gate electrode of the first transistor T1 may be connected to a tenth node N10. The first transistor T2 may control the quantity of current flowing from the first pixel power source ELVDD to the second pixel power source ELVSS via the organic light emitting diode OLED based on a voltage of the tenth node N10.

The third transistor T3 may be connected between a second electrode of the first transistor T1 and the tenth node N10. Further, a gate electrode of the third transistor T3 may be connected to an $i^{th}$ first scan line S1*i*. The third transistor T3 may be turned on when a scan signal is supplied to the $i^{th}$ first scan line S1*i* to electrically connect the second electrode of the first transistor T1 and the tenth node N10. Accordingly, when the third transistor T3 is turned on, the first transistor T1 may be connected in a form of a diode.

The fourth transistor T4 may be connected between the tenth node N10 and the initialization power source Vint. Further, a gate electrode of the fourth transistor T4 may be connected to an $i-1^{th}$ first scan line S1*i*−1. The fourth transistor T4 may be turned on when a scan signal is supplied to the $-1^{th}$ first scan line S1*i*−1 to supply the voltage of the initialization power source Vint to the tenth node N10.

The second transistor T2 may be connected between the $m^{th}$ data line Dm and the first electrode of the first transistor T1. Further, a gate electrode of the second transistor T2 may be connected to an $i^{th}$ first scan line S1*i*. The second transistor T2 may be turned on when a scan signal is supplied to the $i^{th}$ first scan line S1*i* to electrically connect the $m^{th}$ data line Dm and the first electrode of the first transistor T1.

The storage capacitor Cst is connected between the first pixel power source ELVDD and the tenth node N10. The storage capacitor Cst may store the data signal and a voltage corresponding to a threshold voltage of the first transistor T1.

The second pixel PXL2 and the third pixel PXL3 may be implemented with the same circuit as the first pixel PXL1. Further, the pixel structure described with reference to FIG. 19 simply corresponds to one example using the scan line and the emission control line. In another embodiment, the pixels PXL1, PXL2, and PXL3 may have a different pixel structure.

In accordance with one or more of the aforementioned embodiments, an organic light emitting diode OLED may generate various colors of light based on the quantity of current supplied from the driving transistor. For example, the organic light emitting diode OLED may generate white light based on to the quantity of current supplied from the driving transistor. In this case, it is possible to implement a color image using separate color filters. The transistors discussed herein are P-type transistors, but one or more of them may be N-type transistors in another embodiment.

The gate-off and gate-on voltages of the transistors are at different levels according to the type of transistor. For example, for P-type transistors, the gate-off voltage and the gate-on voltage may be high and low level voltages, respectively. For, N-type transistors, the gate-off and gate-on voltages may be low and high level voltages, respectively.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The drivers, controllers, and other processing features described herein may be implemented in logic which, for example, may include hardware, software, or both. When implemented at least partially in hardware, the drivers, controllers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the drivers, controllers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a substrate including a first pixel area and a second pixel area, the second pixel area being smaller than the first pixel area;

first pixels in the first pixel area and connected with first scan lines;

second pixels in the second pixel area and connected with second scan lines;

a first scan driver to supply a first scan signal to the first scan lines;

a second scan driver to supply a second scan signal to the second scan lines; and a first signal line to supply a first driving signal to the first scan driver and the second scan driver, wherein the first signal line includes:

a first sub signal line to supply the first driving signal to the first scan driver; and a second sub signal line to supply the first driving signal to the second scan driver;

wherein the second scan driver includes first stage circuits respectively supplying the second scan signal to the second scan lines, and wherein the second sub signal line includes:

first sub lines respectively supplying the first driving signal to the first stage circuits; and first load matching resistors connected between the first sub lines.

2. The display device as claimed in claim 1, wherein each of the load matching resistors is connected between adjacent two stage circuits among the stage circuits.

3. The display device as claimed in claim 2, wherein a length of a scan line connected to one of the adjacent two stage circuits is different from a length of a scan line connected to another of the adjacent two stage circuits.

4. The display device as claimed in claim 2, wherein a number of the pixels connected to one of the adjacent two stage circuits is different from a number of the pixels connected another of the adjacent two stage circuits.

5. The display device as claimed in claim 1, wherein the first signal line further includes a first additional load matching resistor connected between the first sub signal line and the second sub signal line.

6. The display device as claimed in claim 5, wherein the first sub signal line is to receive the first driving signal and transmit the first driving signal to the second sub signal line through the first additional load matching resistor.

7. The display device as claimed in claim 1, wherein a number of second pixels is less than a number of first pixels.

8. The display device as claimed in claim 1, wherein the second scan lines are shorter than the first scan lines.

9. The display device as claimed in claim 1, wherein the first driving signal includes a clock signal.

10. The display device as claimed in claim 1, wherein the substrate further includes a third pixel area smaller than the first pixel area.

11. The display device as claimed in claim 10, further comprising:

third pixels in the third pixel area and connected with third scan lines;

a third scan driver to supply a third scan signal to the third scan lines; and a second signal line to supply a second driving signal to the third scan driver.

12. The display device as claimed in claim 1, wherein the second pixel area and the third pixel area are at one side of the first pixel area and spaced apart each other.

13. The display device as claimed in claim 11, wherein the third scan driver includes second stage circuits respectively supplying the third scan signal to the third scan lines, and wherein the second signal line includes:

second sub lines respectively supplying the second driving signal to the second stage circuits; and second load matching resistors connected between the second sub lines.

14. The display device as claimed in claim 1, further comprising:

a first emission driver to supply a first emission control signal to the first pixels through first emission control lines;

a second emission driver to supply a second emission control signal to the second pixels through second emission control lines; and a third signal line to supply a third driving signal to the first emission driver and the second emission driver.

15. The display device as claimed in claim 14, wherein the third signal lines includes:

a third sub signal line to supply the third driving signal to the first emission driver; and a fourth sub signal line to supply the third driving signal to the second emission driver;

wherein the second emission driver includes third stage circuits respectively supplying the second emission control signal to the second emission control lines, and wherein the fourth sub signal line includes:

third sub lines respectively supplying the third driving signal to the third stage circuits; and third load matching resistors connected between the third sub lines.

16. The display device as claimed in claim 15, wherein the third signal line further includes a second additional load matching resistor connected between the third sub signal line and the fourth sub signal line.

17. The display device as claimed in claim 16, wherein the second emission control lines are shorter than the first emission control lines.

18. A display device, comprising:

a substrate including a first pixel area, a second pixel area smaller than the first pixel area, and a third pixel area smaller than the second pixel area;

first pixels in the first pixel area and connected with first scan lines;

second pixels in the second pixel area and connected with second scan lines;

third pixels in the third pixel area and connected with third scan lines;

a scan driver to supply a scan signal to the first scan lines, the second scan lines, and the third scan lines; and a first signal line to supply a first driving signal to the scan driver, wherein the scan driver includes a first stage circuits supplying the scan signal to the first scan lines, a second stage circuits supplying the scan signal to the second scan lines, and a third stage circuits supplying the scan signal to the third scan lines, and wherein the first signal line includes:

first to third sub lines respectively supplying the first driving signal to the first to third stage circuits; and first load matching resistors connected between adjacent sub lines among the first to third sub lines, respectively.

19. The display device as claimed in claim 18, wherein the first sub line is to receive the first driving signal and transmit the first driving signal to the third sub signal line through the first load matching resistors.

20. A display device, comprising:

a first scan line, a second scan line, and a third scan line;

first pixels connected with the first scan line;

second pixels connected with the second scan line;

third pixels connected with the third scan line;

a scan driver to supply a scan signal to the first scan line, the second scan line, and the third scan line; and a first signal line to supply a first driving signal to the scan driver, wherein a number of the first pixels, a number of the second pixels, and a number of the third pixels are different each other, wherein the scan driver includes first to third stage circuits respectively supplying the scan signal to the first to third scan lines, and wherein the first signal line includes:

first to third sub lines respectively supplying the first driving signal to the first to third stage circuits; and first load matching resistors connected between adjacent sub lines among the first to third sub lines, respectively.

* * * * *